US010500862B2

(12) United States Patent
Kinoshita

(10) Patent No.: US 10,500,862 B2
(45) Date of Patent: Dec. 10, 2019

(54) LIQUID EJECTING APPARATUS AND CAPPING METHOD

(71) Applicant: SEIKO EPSON CORPORATION, Tokyo (JP)

(72) Inventor: Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,217

(22) Filed: Mar. 6, 2018

(65) Prior Publication Data

US 2018/0257378 A1 Sep. 13, 2018

(30) Foreign Application Priority Data

Mar. 9, 2017 (JP) ..... 2017-045392

(51) Int. Cl.
*B41J 2/165* (2006.01)

(52) U.S. Cl.
CPC ..... *B41J 2/16511* (2013.01)

(58) Field of Classification Search
CPC ..... B41J 2/16511
See application file for complete search history.

(56) References Cited

U.S. PATENT DOCUMENTS

2009/0153615 A1* 6/2009 Chikamoto ..... B41J 2/16585 347/33
2010/0079538 A1* 4/2010 Ueno ..... B41J 2/16547 347/32
2010/0128081 A1 5/2010 Ito
2015/0202904 A1 7/2015 Okuda

FOREIGN PATENT DOCUMENTS

JP 2008-296518 A 12/2008
JP 2010-125599 A 6/2010
JP 2015-134447 A 7/2015

* cited by examiner

*Primary Examiner* — Lamson D Nguyen
(74) *Attorney, Agent, or Firm* — Workman Nydegger

(57) ABSTRACT

There is provided a liquid ejecting apparatus including: a liquid ejecting head that has a nozzle-formed surface; guide shafts that guide the liquid ejecting head in a direction in which the liquid ejecting head is lifted and lowered; a cap that is lifted and lowered in the direction and covers the nozzle-formed surface; and a restrainer that restrains the liquid ejecting head against the cap at a position shifted from the center of the cap when viewed from the direction.

17 Claims, 15 Drawing Sheets

LIQUID EJECTING APPARATUS AND CAPPING METHOD

CROSS REFERENCES TO RELATED APPLICATIONS

This application claims priority to Japanese Patent Application No. 2017-045392 filed on Mar. 9, 2017. The entire disclosures of Japanese Patent Application No. 2017-045392 are hereby incorporated herein by reference.

BACKGROUND

1. Technical Field

The present invention relates to a liquid ejecting apparatus and a capping method, the liquid ejecting apparatus including a liquid ejecting head which ejects a liquid from nozzles and a cap that caps a nozzle-formed surface of the liquid ejecting head, particularly, to an ink jet type recording apparatus using ink as a liquid and a capping method.

2. Related Art

For example, as a liquid ejecting apparatus, there has been known an ink jet type recording apparatus that ejects ink droplets as a liquid so as to perform printing on an ejection target medium such as paper or a recording sheet.

The ink jet type recording apparatus is provided with an ink jet type recording head that ejects ink, as ink droplets, which is supplied from an ink tank or an ink cartridge in which the ink is stored.

The ink jet type recording head includes a flow path that communicates with a nozzle opening and a drive element such as a piezoelectric actuator that causes a change in pressure to the ink in the flow path, and the drive element performs driving, thereby causing the change in pressure to the ink in the flow path, such that the ink droplets are discharged from the nozzle openings.

The ink jet type recording head adjusts a position of the nozzle-formed surface with respect to an apparatus main body by a lifting/lowering mechanism, thereby making it possible to adjusting a gap between the nozzle-formed surface and an ejection target medium such as paper, that is, a so-called paper gap, (for example, refer to JP-A-2015-134447).

However, when the nozzle-formed surface of the ink jet type recording head is capped with the cap, a problem arises in that the ink jet type recording head is likely to float due to a load of the cap. Therefore, there is provided a restrainer that restrains the ink jet type recording head from floating. In this manner, although it is possible to restrain the ink jet type recording head from floating, the restrainer needs to have stiffness to withstand the load of the cap. Therefore, a problem arises in that the restrainer increases in size and costs.

In addition, when a load used when the cap is brought into contact with the nozzle-formed surface in order to restrain the restrainer from being deformed, a problem arises in that low adhesiveness between the nozzle-formed surface and the cap is obtained and it is not possible to reliably perform a suction operation by the cap or restrain ink from evaporating from the nozzle-formed surface.

Such problems arise not only in the ink jet type recording apparatus but also in a liquid ejecting apparatus that ejects a liquid other than an ink.

SUMMARY

An advantage of some aspects of the invention is to provide a liquid ejecting apparatus and a capping method in which it is possible to easily restrain floating of the liquid ejecting head due to a load of a cap and it is possible to improve adhesiveness between the cap and the liquid ejecting head.

According to an aspect of the invention, there is provided a liquid ejecting apparatus including: a liquid ejecting head that have a nozzle-formed surface; guide shafts that guide the liquid ejecting head in a direction in which the liquid ejecting head is lifted and lowered; a cap that is lifted and lowered in the direction and covers the nozzle-formed surface; and a restrainer that restrains the liquid ejecting head against the cap at a position shifted from the center of the cap when viewed from the direction.

In this configuration, since the liquid ejecting head restrained by the restrainer tilts to come into contact with the guide shaft due to the load of the cap, both of the restrainer and the guide shaft can receive the load of the cap. Hence, even when a material having relatively low stiffness is used as the restrainer, it is possible to restrain the restrainer from being deformed or damaged, and it is possible to reduce the size or costs of the restrainer.

Here, it is preferable that the guide shafts be provided at a plurality of positions in an elongating direction in a case where the nozzle-formed surface is viewed in the direction. In this configuration, the plurality of guide shafts are provided in the elongating direction of the liquid ejecting head, and thereby it is possible to restrain the nozzle-formed surface of the liquid ejecting head from tilting in the elongating direction.

In addition, it is preferable that the liquid ejecting head come into contact with the guide shafts in a tilting state and the liquid ejecting head have the same tilting angle between the plurality of guide shafts. In this configuration, the liquid ejecting head has the same tilting angle between the plurality of guide shafts, and thereby it is possible to decrease stress in a torsional direction applied to the liquid ejecting head such that it is possible to restrain the liquid ejecting head from being deformed. In particular, the cap comes into repeated contact with the liquid ejecting head, and thereby the stress in the torsional direction is repeatedly applied to the liquid ejecting head. In this manner, it is possible to restrain the liquid ejecting head from being deformed and damaged.

In addition, it is preferable that the liquid ejecting head is provided with a bearing for each guide shaft and the bearings be provided at an interval different for each guide shaft in a direction along a line connecting the plurality of guide shafts. In this configuration, it is possible to perform positioning with high accuracy on a side on which a narrow interval is formed between the guide shaft and the bearing and it is possible to absorb tolerance variations on a side on which a wide interval is formed between the guide shaft and the bearing.

In addition, it is preferable that the liquid ejecting head be provided with a plurality of bearings having different diameters for the one guide shaft and the centers of the bearings be shifted when viewed in the direction. In this configuration, the liquid ejecting head can tilt so as to come into contact with the guide shaft, and it is possible to regulate the tilt to the smallest extent in a case of not tilting.

According to another aspect of the invention, there is provided a capping method including: preparing a liquid ejecting head that has a nozzle-formed surface, a guide shaft that guides the liquid ejecting head in a direction in which the liquid ejecting head is lifted and lowered, a cap that is lifted and lowered in the direction and covers the nozzle-formed surface, and a restrainer that restrains the liquid ejecting head against the cap at a position shifted from the center of the cap when viewed in the direction; and causing the liquid ejecting head to tilt so as to come into contact with the guide shaft by causing the cap to come into contact with the liquid ejecting head in a state in which the restrainer restrains the liquid ejecting head.

In this configuration, since the liquid ejecting head restrained by the restrainer tilts and comes into contact with the guide shaft due to the load of the cap, the restrainer and the guide shaft can receive the load of the cap. Hence, even when the material having relatively low stiffness is used as the restrainer, it is possible to decrease deformation and damage to the restrainer, and it is possible to reduce the size or costs of the restrainer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the bases of embodiments.

Embodiment 1

Figure 1:
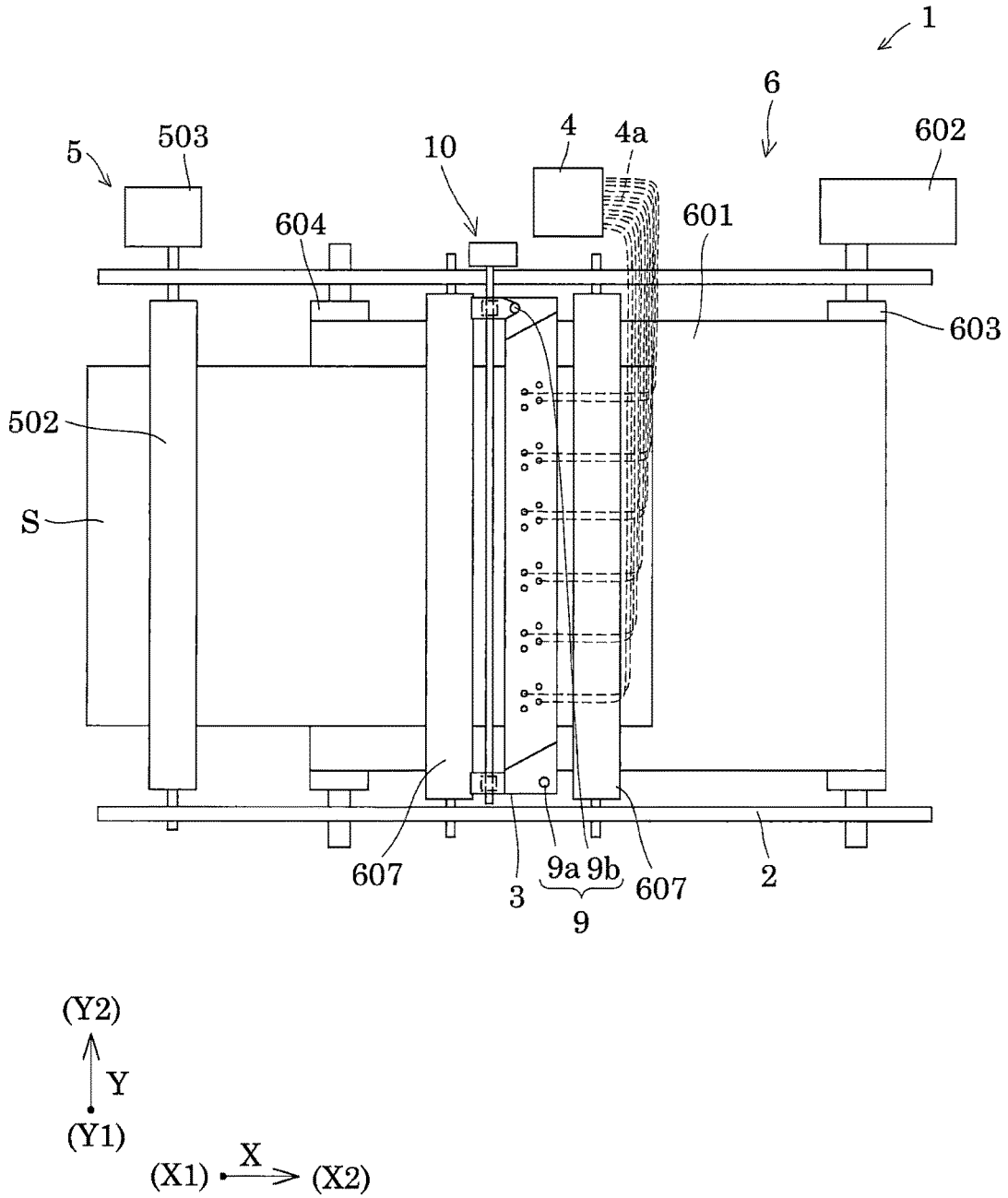
FIG. 1 is a top view illustrating a schematic configuration of a recording apparatus according to Embodiment 1.
Figure 2:
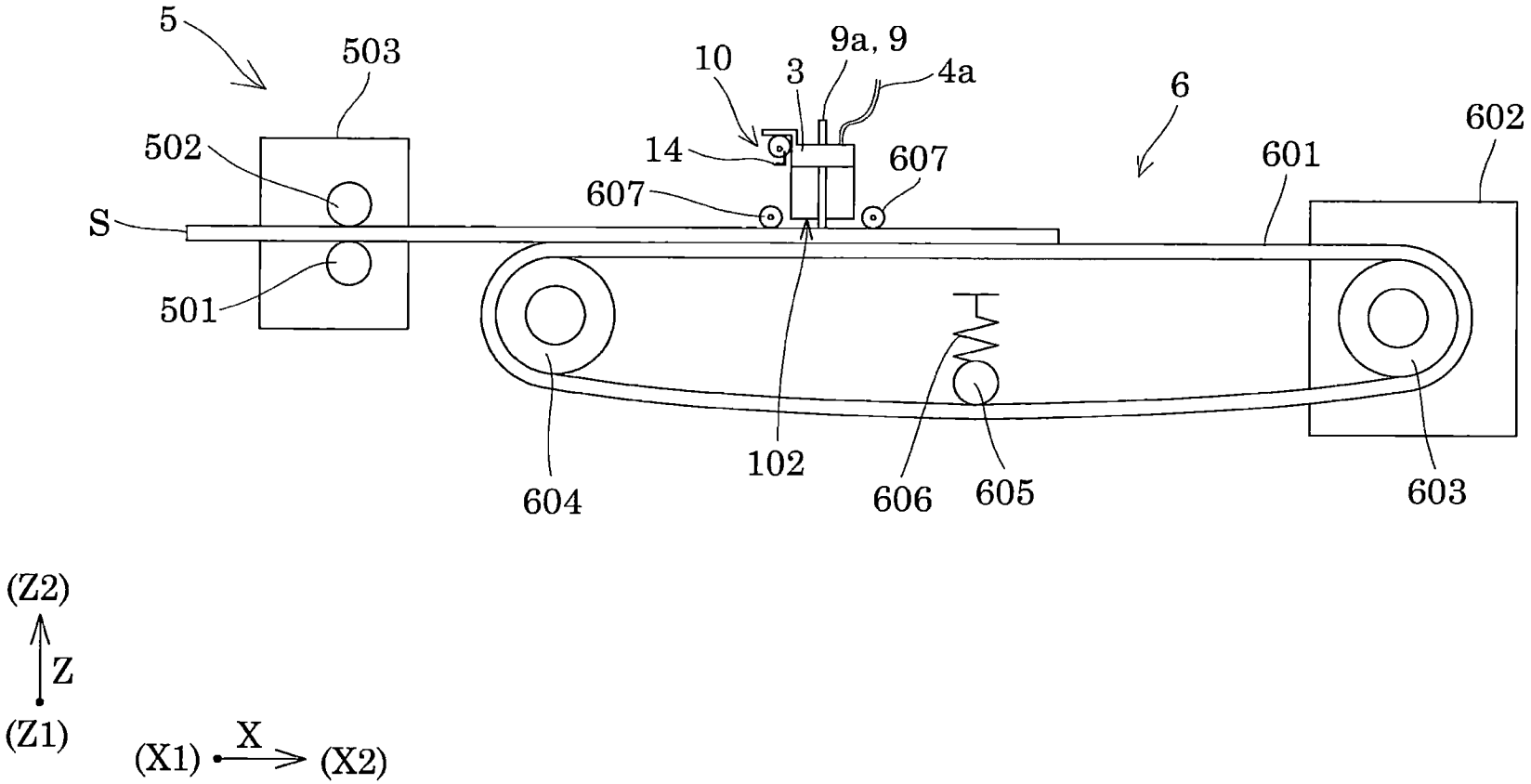
FIG. 2 is a side view illustrating the schematic configuration of the recording apparatus according to Embodiment 1.

FIG. 1 is a top view illustrating a schematic configuration of an ink jet type recording apparatus as an example of a liquid ejecting apparatus according to Embodiment 1 of the invention. FIG. 2 is a side view illustrating the ink jet type recording apparatus.

As illustrated in FIGS. 1 and 2, the ink jet type recording apparatus as the example of the liquid ejecting apparatus of the embodiment is a so-called line type recording apparatus 1 that transports a recording sheet S as an ejection target medium and performs printing.

Here, in the embodiment, a transport direction of the recording sheet S is referred to as a first direction X, and a direction orthogonal to the first direction X in an in-plane direction of a surface of the recording sheet S, on which ink lands, is referred to as a second direction Y. In addition, a direction orthogonal to both of the first direction X and the second direction Y, that is, a direction orthogonal to the surface of the recording sheet S on which the ink lands, is referred to as a third direction Z. Further, in the third direction Z, a side of the recording sheet S is referred to as Z1 and a side of the ink jet type recording head is referred to as Z2. In the embodiment, an example in which the directions (X, Y, and Z) are orthogonal to each other is described; however, the definitions of the directions are not necessarily limited thereto.

An ink jet type recording apparatus 1 includes an apparatus main body 2, an ink jet type recording head 3 (hereinafter, also simply referred to as a recording head 3) provided to be liftable and lowerable with respect to the apparatus main body 2 in the third direction Z, a liquid storing unit 4 such as an ink tank in which ink as a liquid is stored, and a first transport unit 5 and a second transport unit 6 that transport the recording sheet S.

The recording head 3 extends in the second direction Y. In the embodiment, the recording head 3, which will be described below in detail, includes a plurality of head main bodies 100 that discharge ink, and a unit base 200 that holds the plurality of head main bodies 100 (refer to FIG. 3).

The recording head 3 is provided to be movable in an axial direction of a guide shaft 9 having the axial direction parallel to the third direction Z. In other words, the guide shaft 9 guides movement of the recording head 3 in the third direction Z. The guide shaft 9 will be described below in detail. In the embodiment, a plurality of guide shafts 9 are provided in the second direction Y as an elongating direction in a case where a nozzle-formed surface 102 of the recording head 3 is viewed in the third direction Z as a lifting/lowering direction of the recording head 3. In the embodiment, two guide shafts of a first guide shaft 9*a* and a second guide shaft 9*b* are provided at both end portions in the second direction Y, respectively.

The liquid storing unit 4 supplies ink to the recording head 3 and is fixed to the apparatus main body 2 in the embodiment. The ink from the liquid storing unit 4 fixed to the apparatus main body 2 is supplied to the recording head 3 via a supply duct 4*a* such as a tube. An example, in which the recording head 3 includes the liquid storing unit 4, for example, the liquid storing unit 4 is mounted above the recording head 3 on the Z2 side, may be employed.

The first transport unit 5 is provided on one side of the recording head 3 in the first direction X, and thus on an X1 side in the embodiment. In the embodiment, an upstream side of the recording head 3 in the transport direction in the first direction X is referred to as the X1 side, and a downstream side thereof is referred to as an X2 side.

The first transport unit 5 includes a first transport roller 501 and a first driven roller 502 that is driven by following the first transport roller 501. The first transport roller 501 is provided on a side opposite to the surface of the recording sheet S on which the ink lands, that is, on the Z1 side, and is driven by a drive force from a first drive motor 503. In addition, the first driven roller 502 is provided on the side of the surface of the recording sheet S on which the ink lands, that is, on the Z2 side, and the recording sheet S is nipped between the first transport roller 501 and the first driven roller 502. The first driven roller 502 presses the recording sheet S toward the side of the first transport roller 501 with a bias member such as a spring not illustrated.

The second transport unit 6 includes a transport belt 601, a second drive motor 602, a second transport roller 603, a second driven roller 604, a tension roller 605, and pressing rollers 607.

The second transport roller 603 of the second transport unit 6 is driven by a drive force from the second drive motor 602. The transport belt 601 is formed by an endless belt and loops around outer circumferences of the second transport roller 603 and the second driven roller 604. The transport belt 601 is provided on the Z1 side of the recording sheet S. The tension roller 605 is provided between the second transport roller 603 and the second driven roller 604, comes into contact with an inner circumferential surface of the transport belt 601, and applies tension to the transport belt 601 due to a bias force from a bias member 606 such as a spring. In this manner, the transport belt 601 is disposed between the second transport roller 603 and the second driven roller 604 so as to have a flat surface that faces the recording head 3.

The pressing rollers 607 of the second transport unit 6 are provided on the X1 side and the X2 side of the recording head 3, respectively, on the Z2 side of the recording sheet S. The recording sheet S is nipped between the two pressing rollers 607 and the transport belt 601, and thereby a flat posture of the recording sheet S is maintained.

In the ink jet type recording apparatus 1, while the first transport unit 5 and the second transport unit 6 transport the recording sheet S with respect to the recording head 3 from the X1 side to the X2 side in the first direction X, the ink is ejected from the head main bodies 100 of the recording head 3, the ejected ink is caused to land on a surface of the recording sheet S on the Z2 side, and so-called printing is performed.

In addition, the ink jet type recording apparatus 1 includes a cap which is not particularly illustrated. The cap comes into contact with a nozzle-formed surface of the recording head 3 and covers nozzles. The cap will be described below in detail. For example, the recording head 3 may be movable in the second direction Y, and thus the cap may be disposed next to the first transport unit 5 in the second direction Y. In addition, the recording head 3 may be movable to the Z2 side of the third direction Z and in the first direction X, and thus the recording head 3 may be opposite to the cap.

In addition, the ink jet type recording apparatus 1 includes a restrainer 14 that restrains movement of the recording head 3 due to the load of the cap when the cap comes into contact with the recording head 3. The restrainer 14 of the embodiment will be described below in detail. The restrainer 14 is provided on a lifting/lowering mechanism 10 that lifts and lowers the recording head 3 in the third direction Z, comes into contact with the surface of the recording head 3 on the Z2 side, and regulates the movement of the recording head 3 to the Z2 side, that is, lifting of the recording head in the third direction Z.

Figure 3:
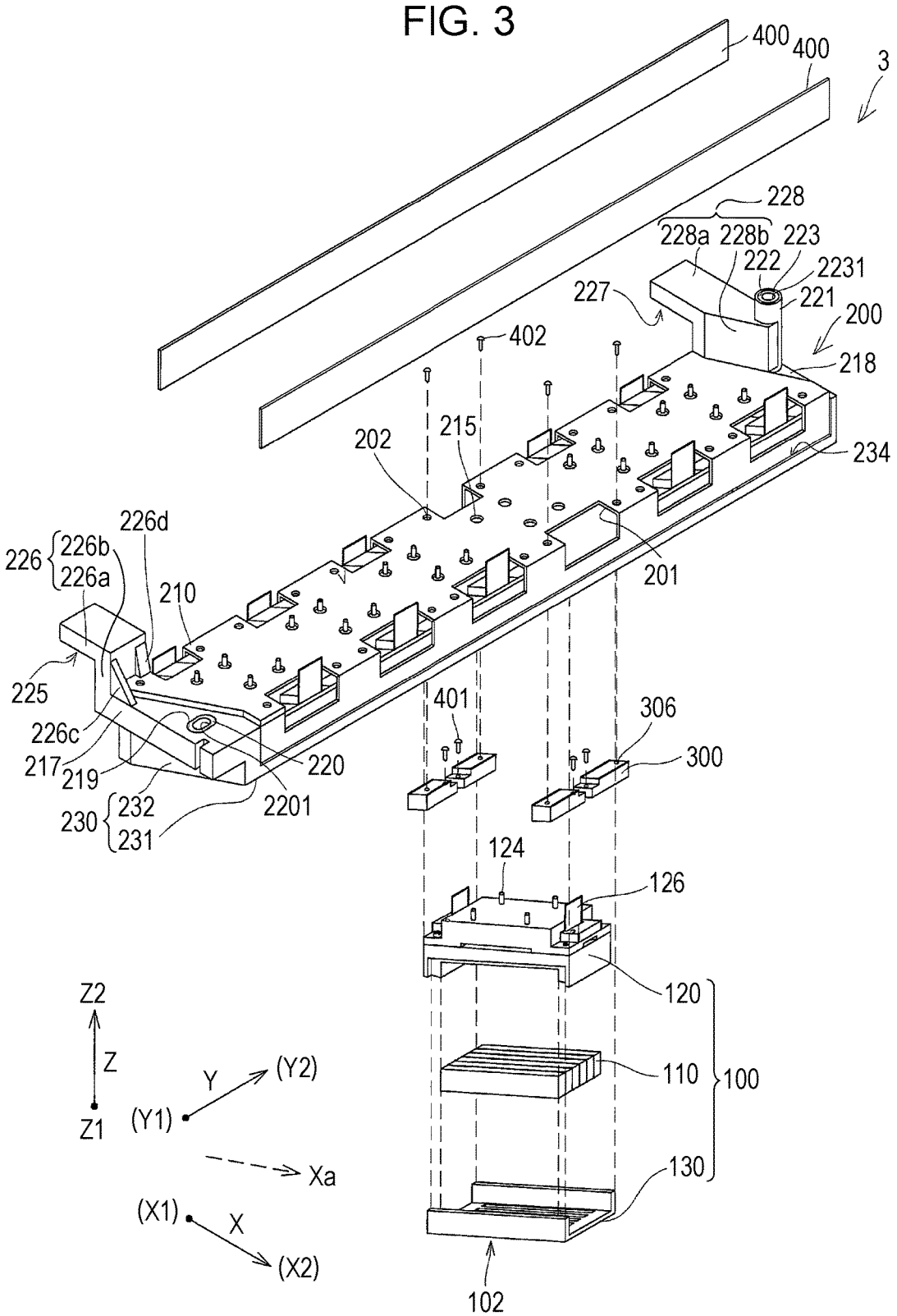
FIG. 3 is an exploded perspective view illustrating a part of a recording head according to Embodiment 1.
Figure 4:
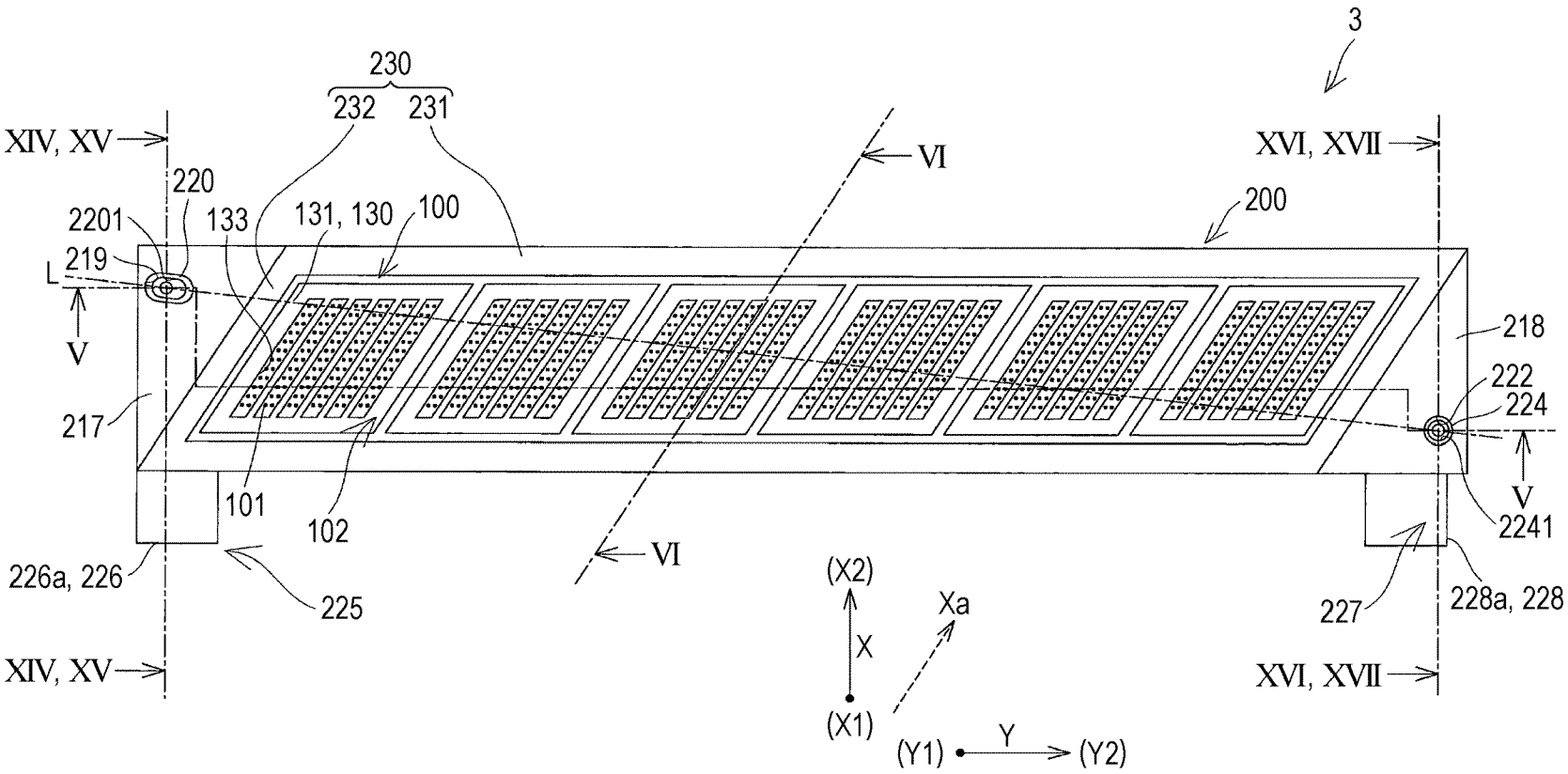
FIG. 4 is a bottom view of the recording head according to Embodiment 1.
Figure 5:
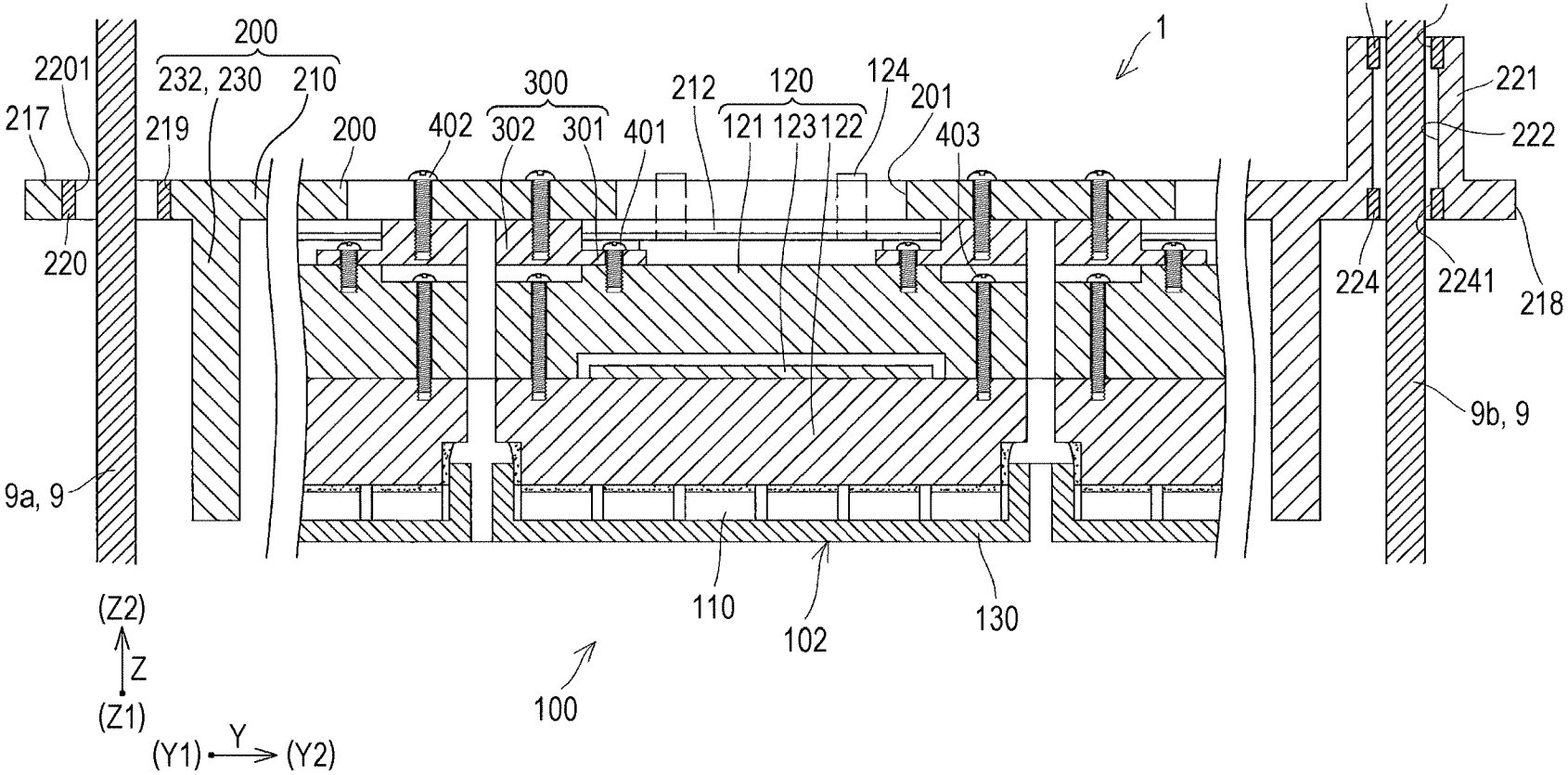
FIG. 5 is a sectional view of the recording head according to Embodiment 1.
Figure 6:
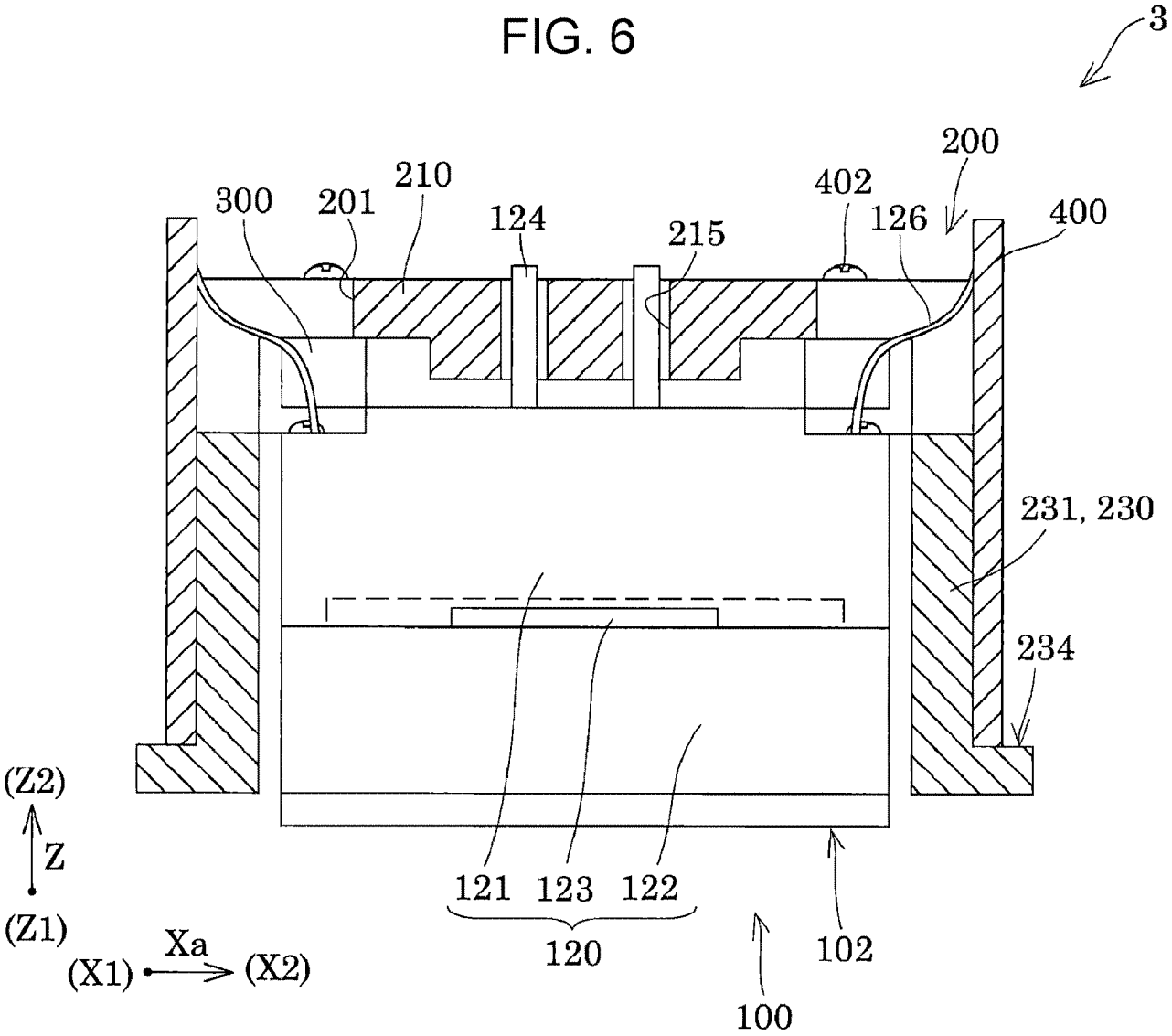
FIG. 6 is a cross-sectional view of the recording head according to Embodiment 1.

Here, the recording head 3 that is mounted in the ink jet type recording apparatus 1 is more described in detail with reference to FIGS. 3 to 6. FIG. 3 is an exploded perspective view illustrating a part of the ink jet type recording head as an example of a liquid ejecting head according to Embodiment 1 of the invention. FIG. 4 is a bottom view illustrating the recording head. FIG. 5 is a sectional view taken along line V-V in FIG. 4. FIG. 6 is a cross-sectional view taken along line VI-VI in FIG. 4. In addition, in the embodiment, the direction of the recording head 3 are described based on the directions defined when the recording head 3 is mounted in the ink jet type recording apparatus 1, that is, the first direction X, the second direction Y, and the third direction Z.

As illustrated in FIGS. 3 to 6, the recording head 3 of the embodiment includes the plurality of head main bodies 100, the unit base 200 that holds the plurality of head main bodies 100, and a spacer 300 provided between the unit base 200 and the head main body 100.

As illustrated in FIGS. 4 and 5, the head main body 100 includes a nozzle-formed surface 102 provided with nozzle openings 101 in the surface on the Z1 side. The nozzle openings 101 are fixed such that a nozzle array is inclined with respect to the first direction X in an in-plane direction of the nozzle-formed surface 102. In other words, an alignment direction of the nozzle openings 101 that configure the nozzle array is referred to as a fourth direction Xa inclined with respect to the first direction X. In addition, a plurality of nozzle arrays are provided side by side in the second direction Y on the nozzle-formed surface 102.

In addition, the head main body 100 has a substantially parallelogrammic shape in the second direction Y and the fourth direction Xa, in a plan view from the side of the nozzle-formed surface 102. It is needless to say that the shape of the head main body 100 viewed in plan view from the side of the nozzle-formed surface 102 is not limited to the substantially parallelogrammic shape, and the head main body may have a rectangular shape, a trapezoidal shape, a polygonal shape, or the like.

Further, the plurality of head main bodies 100 are aligned in the second direction Y orthogonal to the first direction X as the transport direction of the recording sheet S, and are fixed to the unit base 200. In the embodiment, the plurality of head main bodies 100 are aligned in the second direction Y, that is, are provided side by side in a straight line in the second direction Y. In other words, the plurality of head main bodies 100 are not disposed to be shifted from one another in the first direction X. In this manner, it is possible to decrease a width of the recording head 3 in the first direction X, and thus it is possible to decrease the recording head 3 in size. In the embodiment, the head main bodies 100 are aligned in the second direction Y, and thereby the recording head 3 has an elongated length in the second direction Y, and has a short length in the first direction X. In other words, the recording head 3 has a longitudinal direction in the second direction Y and has a short direction in the first direction X.

The head main body 100 is configured to include a plurality of members which are stacked. Specifically, as illustrated in FIGS. 3 and 5, the head main body 100 of the embodiment includes a plurality of head chips 110 provided with the plurality of nozzle openings 101 from which ink droplets are discharged, holding members 120 that hold the plurality of head chips 110, and covers 130 as fixing plates provided on the Z1 side of the head chips 110. The head chip 110, the holding member 120, and the cover 130 are stacked in the third direction Z. In the embodiment, a surface of the head main body 100 on the Z1 side is referred to as the nozzle-formed surface 102.

In addition, in the inside (not illustrated) of the head chip 110, a liquid flow path that communicates with the nozzle opening 101, a pressure generating unit that causes a change in the pressure to the ink in the liquid flow path, and the like are provided. As the pressure generating unit, it is possible to use a pressure generating unit that changes a volume of the liquid flow path due to deformation of a piezoelectric actuator having a piezoelectric material with an electromechanical converting function, that causes a change in the pressure to the ink in the liquid flow path, and that discharges ink droplets from the nozzle openings 101, a pressure generating unit in which a heating element is disposed in the liquid flow path and ink droplets are caused to be discharged from the nozzle openings 101 due to bubbles produced by the heating of the heating element, or a so-called electrostatic actuator that generates an electrostatic force between a vibration plate and an electrode, in which the vibration plate is deformed due to the electrostatic force, and that discharges ink droplets from the nozzle openings 101, or the like.

In the embodiment, as illustrated in FIGS. 3 and 4, two nozzle arrays in which the nozzle openings 101 are aligned in the fourth direction Xa are provided on each of the head chips 110 in the second direction Y. In other words, since six head chips 110 are provided in one recording head 3, a total of 12 nozzle arrays are provided in one recording head 3. The number of the head chips 110 provided in one recording head 3 is not particularly limited. In addition, one head chip 110 may be provided with one nozzle array or may be provided with three nozzle arrays.

The holding member 120 includes a flow-path member 121, a holder 122, and a wiring substrate 123 held between the flow-path member 121 and the holder 122. The wiring substrate 123 is provided to be exposed on a stack interface between the flow-path member 121 and the holder 122. In addition, a cable 126 connected to the wiring substrate 123 is guided out through the surface of the head main body 100 on the Z2 side.

The plurality of head main bodies 100 are fixed to the unit base 200. In the embodiment, six head main bodies 100 are fixed to unit base 200 via the spacer 300.

The spacer 300 is fastened to the surface of the head main body 100 on the Z2 side with the first screw member 401. In addition, the spacer 300 is fastened to a surface of the unit base 200 on the Z1 side with a second screw member 402. In this manner, the head main bodies 100 are fixed to the unit base 200 via the spacer 300.

In addition, the spacer 300 fixed to the head main body 100 with the first screw member 401 is fixed to the unit base 200 with the second screw member 402, and thereby it is possible to easily attach or detach the head main body 100 to and from the unit base 200. However, the fixing of the spacer 300 and the head main body 100 is not limited to the fixing with the first screw member 401 and may be fixed by adhesion with an adhesive. In addition, the spacer 300 may be integrally provided to a part of the head main body 100.

The head main body 100 is attachable to and detachable from the unit base 200, and thereby it is possible to selectively replace only the broken head main body 100 when the plurality of head main bodies 100 provided in the recording head 3 malfunction. In other words, since there is no need to replace the entire recording head 3 in response to the malfunction of one head main body 100, it is possible to reduce costs. In addition, also during assembly of the recording head 3, it is possible to selectively replace a head main body 100 which does not have the same ejection characteristics of ink droplets, and thus, it is possible to increase a yield ratio.

In addition, in the embodiment, the first screw member 401, with which the head main body 100 and the spacer 300 are fixed to each other, or the second screw member 402, with which the unit base 200 and the spacer 300 are fixed to each other, is detachably fixed by being screwed from a side opposite to the nozzle-formed surface 102 of any head main body 100. Hence, it is possible to reduce an occurrence of a problem arising in that ink attached to the first screw member 401 or the second screw member 402 drops down on the recording sheet S or the like at an unexpected timing. In addition, the first screw member 401 and the second screw member 402 have the same direction of screwing and, thus, are screwed with good workability.

In the embodiment, one head main body 100 is provided with four spacers 300. Specifically, the spacers 300 are provided on four respective corners in a surface of the head main body 100 in the first direction X and the second direction Y.

In addition, a plurality of types of spacers 300, which have different thicknesses from each other, can be prepared and can adjust relative heights of the plurality of head main bodies 100 in the third direction Z, and thereby it is possible to easily have the same heights and tilt of the nozzle-formed surfaces 102 of the plurality of head main bodies 100. In particular, in the embodiment, the spacer 300 is attachable to and detachable from the head main body 100, and thereby it is possible to easily perform replacement with the spacer 300 having a different thickness. Hence, it is possible to reduce an occurrence a shift of a landing position of ink droplets which are ejected from the head main bodies 100 such that it is possible to improve the print quality.

Figure 7:
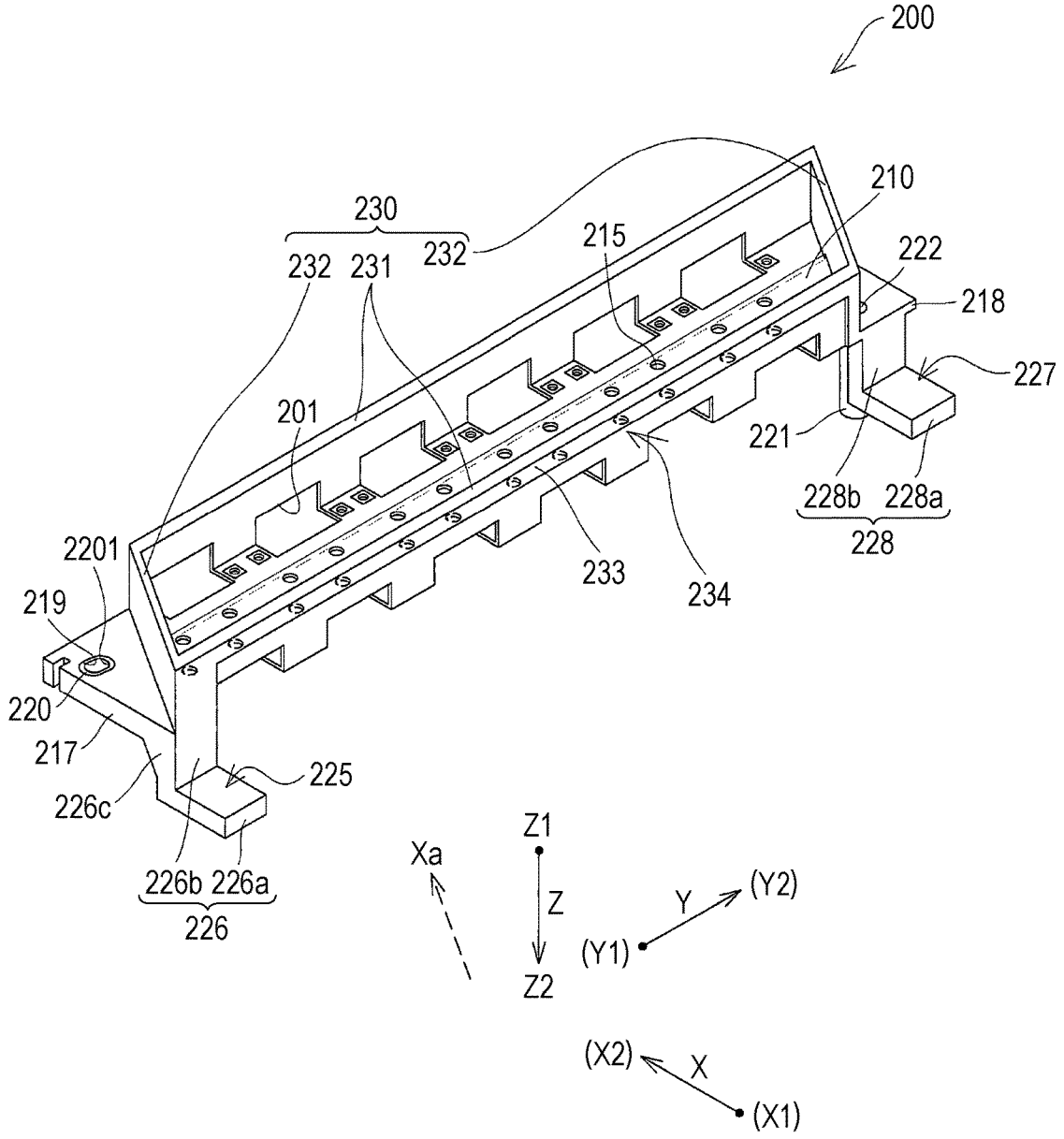
FIG. 7 is a perspective view illustrating a unit base when viewed from a Z1 side according to Embodiment 1.

The unit base 200, to which the head main bodies 100 are fixed via the spacers 300, is more described with reference to FIG. 7. FIG. 7 is a perspective view illustrating the unit base 200 when viewed from the side of the bottom.

As illustrated in FIG. 7, the unit base 200 includes a bottom portion 210 and a wall portion 230 provided on the Z1 side of the bottom portion 210. For example, it is possible to form the unit base 200 through cutting work or molding, using metal such as an aluminum alloy, a resin, or the like.

The bottom portion 210 has a plate shape with a plane direction including the first direction X and the second direction Y. The bottom portion 210 is provided with a supply hole 215 that penetrates therethrough in the third direction Z. A flow path of the head main body 100 fixed to the bottom portion 210 is exposed on the Z2 side, and the exposed flow path through the supply hole 215 is connected with the supply duct **4*a* such as a tube from the Z2 side (refer to FIG. 1). In other words, inks are supplied to the head main body 100 from the Z2 side. In the embodiment, the supply duct 4*a* is directly connected to the head main body 100 from the Z2 side of the bottom portion 210; however, the configuration is not particularly limited thereto, and another flow-path member may be provided on the Z2 side of the bottom portion 210, the supply duct 4*a* may be connected to the other flow-path member, and the ink may be supplied to the head main body 100 from the supply duct 4*a*** via the other flow-path member.

Since the plurality of head main bodies 100 are aligned in the second direction Y and are fixed to the bottom portion 210, the bottom portion 210 elongates (a longitudinal direction) in the second direction Y, and the bottom portion 210 is short (a short direction) in the first direction X.

The wall portion 230 includes two first wall portions 231 provided to be continuous in the second direction Y as an alignment direction of the head main bodies 100 and two second wall portions 232 that connects end portions of the two first wall portions 231 to each other. In other words, the wall portion 230 has a quadrangular ring shape in which the two first wall portions 231 and the two second wall portions 232 are formed to be continuous to each other.

Specifically, the first wall portions 231 are formed by a plate-like member and are provided to be upright at both end portions of the bottom portion 210 in the first direction X, respectively, so as to extend from the bottom portion 210 in a direction perpendicular to the plane direction of the bottom portion 210, that is, on the Z1 side of the third direction Z. In addition, the first wall portion 231 is provided to be continuous in the second direction Y as the alignment direction of the head main bodies 100. In other words, the first wall portion 231 is formed by the plate-like member and is disposed so as to have a front surface that is formed in directions including the second direction Y and the third direction Z.

The second wall portions 232 are provided to be upright at both end portions of the bottom portion 210 in the second direction Y, respectively, so as to extend from the bottom portion 210 in a direction perpendicular to the plane direction of Z1 of the bottom portion 210, that is, on the Z1 side of the third direction Z. In addition, the second wall portion 232 is provided to be continuous in an inclined direction with respect to the first direction X, that is, in the fourth direction Xa as the alignment direction of the nozzle openings 101 of the head main bodies 100 in the embodiment. In other words, the second wall portion 232 is formed by a plate-like member and is disposed so as to have a front surface that is formed in directions including the fourth direction Xa and the third direction Z.

In addition, end portions of the first wall portions 231 and the second wall portions 232 are connected to each other. In the embodiment, the first wall portions 231 and the second wall portions 232 are integrally provided to be a continuous wall. Hence, the wall portion 230 is formed to have a ring shape surrounding the plurality of head main bodies 100 by the two first wall portions 231 and the two second wall portions 232.

The ring-shaped wall portion 230 enables the unit base 200 to have an increase in stiffness. In other words, the first wall portion 231 enables the unit base to have an increase in stiffness against the bending moment in the second direction Y, compared to a case where only the bottom portion 210 is provided as the unit base 200. In other words, the second wall portion 232 provided on the bottom portion 210 enables the unit base to have an increase in stiffness against the bending moment in the first direction X. The first wall portion 231 and the second wall portion 232 enable the unit base to have an increase in stiffness against the torsional moment. In the embodiment, the wall portion 230 has the ring shape with the first wall portions 231 and the second wall portions 232 formed as a continuous wall, and thereby it is possible to increase the stiffness against the bending moment in the first direction X and the second direction Y and to increase the stiffness against the torsional moment. Hence, even when a load is increased, with a cap 15 coming into contact with the nozzle-formed surface 102 of the recording head 3, it is possible to restrain the unit base 200 from being deformed.

In addition, in the embodiment, since the head main bodies 100 are arranged in a row in the second direction Y, the unit base 200 is likely to elongate in the second direction Y with a high aspect ratio. However, the wall portion 230, which is continuous in the alignment direction of the head main bodies 100 on the unit base 200, particularly the first wall portion 231, makes it possible to increase the stiffness of the unit base 200 in the longitudinal direction in which the unit base 200 is likely to be deformed so as to restrain the deformation thereof.

Further, in the embodiment, as described above, since the spacer 300 fixed to the head main body 100 is fixed to be screwed into the unit base 200 from the side opposite to the Z1 side on which the head main body 100 is fixed to the unit base 200, the spacer 300 does not project on the nozzle-formed surface 102 of the head main body 100 in the second direction Y, and thus it is possible to dispose the spacer 300 within the outer shape of the head main body 100 in the second direction Y. Hence, it is possible to decrease the interval between the head main bodies 100 which are aligned in the second direction Y and are adjacent to each other, and it is possible to decrease the width of the unit base 200 in the first direction X. The decrease in the width of the recording head 3 in the first direction X makes it possible to increase the stiffness of the unit base 200.

In addition, since the wall portion 230 provided in the unit base 200 makes it possible to increase the stiffness of the bottom portion 210, there is no need to increase the thickness of the bottom portion 210 and it is possible to less increase the weight of the unit base 200 such that it is possible to restrain the deformation due to the own weight and it is possible to decrease the size. Incidentally, in a case where the wall portion 230 is not provided in the unit base 200 and only the bottom portion 210 is provided, the thickness has to be increased in the third direction Z such that the stiffness of the bottom portion 210 is increased, then, the own weight is increased and the size is increased. In the embodiment, the wall portion 230 is provided in the unit base 200, and thereby it is possible to increase the stiffness of the unit base 200 and to decrease the weight and the size thereof.

As illustrated in FIGS. 3 and 5, the plurality of head main bodies 100 are fixed to the surface of the unit base 200 on the Z1 side, that is, the surface of the bottom portion 210 on the Z1 side. The head main bodies 100 are fixed as described above, and thereby the stiffness of the unit base 200 is also improved. In addition, in the embodiment, the wall portion 230 and the head main bodies 100 are provided on the bottom portion 210 on the same Z1 side, and the wall portion 230 covers principal side surfaces of the head main bodies 100. In this manner, it is possible to reduce an occurrence of a state in which the head main body 100 comes into contact with another member during work such as attaching the recording head 3 to the ink jet type recording apparatus 1. In addition, it is possible to reduce an occurrence of a state in which the recording sheet S comes into contact with the head main body 100 due to a paper jam or the like. Hence, it is possible to reduce an occurrence of a case where another member comes into contact with the head main body 100 such that it is possible to restrain the head main body 100 from being damaged.

It is preferable that the wall portion 230 be formed to have a size to cover interfaces of the members stacked to configure the head main body 100 in the third direction Z. In the embodiment, as illustrated in FIGS. 5 and 6, the holding member 120 that configures the head main body 100 includes the flow-path member 121, the holder 122, and the wiring substrate 123 held between the flow-path member 121 and the holder 122. As illustrated in FIG. 6, the wiring substrate 123 is provided to be exposed on a stack interface between the flow-path member 121 and the holder 122. Therefore, the wall portion 230 covers the interface through which the wiring substrate 123 is exposed, that is, the stack interface between the flow-path member 121 and the holder 122, and thereby it is possible to decrease an amount of ink attached to the wiring substrate 123. The wiring substrate 123 may be provided to be exposed through the interface formed between the flow-path member 121 and the holder 122 which are stacked. In other words, the interface between the members, which are stacked to configure the head main body 100, is not limited to the interface through which the wiring substrate 123 is exposed, and the interface may be an interface on which adhesion is performed with an adhesive or the like. The interface, on which the adhesion is performed with the adhesive, is covered with the wall portion 230, and thereby it is possible to decrease an occurrence of erosion of the adhesive by the ink such that it is possible to less decrease the strength of the adhesion. It is needless to say that the adhesive may not be provided on the interface between the members stacked to configure the head main body 100. The interface is covered with the wall portion 230 in any case, and thereby it is possible to decrease an amount of inks infiltrated in the head main body 100 from the interface. Incidentally, in the embodiment, the wall portion 230 is provided to have a size to approach the nozzle-formed surface 102. However, since the nozzle-formed surface 102 needs to be wiped with a wiper and to have a small distance to the recording sheet S, that is, a so-called small paper gap, it is preferable that the nozzle-formed surface 102 side of the head main body 100 more project to the Z1 side than the wall portion 230.

In addition, the plurality of head main bodies 100 are held in the unit base 200, and thereby it is possible to increase the yield ratio, compared to a case where a plurality of nozzle arrays are provided in the head main body 100 and multiple arrays are formed. However, the plurality of head main bodies 100 are held in the unit base 200, and thereby the weight of all of the plurality of head main bodies 100 is likely to be increased; however, the wall portion 230 is provided on the unit base 200, and thereby the stiffness of the unit base is increased such that it is possible to restrain the unit base 200 from being deformed due to the increase in weight of the head main bodies 100.

In addition, the unit base 200 is provided with a cable opening 201 into which the cable 126 connected to the wiring substrate 123 of the head main body 100 is inserted. In the embodiment, the cable opening 201 is provided over a boundary between the bottom portion 210 and the wall portion 230. The cable 126 of the head main body 100 fixed to the unit base 200 via the cable opening 201 is guided out to the Z2 side.

In addition, a step 234 is formed on the outer circumferential surface of the first wall portion 231, and a relay substrate 400 is accommodated in the step 234. Here, the relay substrate 400 is formed by a rigid substrate and is fixed in the step 234 with a screw or the like. As illustrated in FIGS. 3 and 6, a plurality of cables 126 guided out through the cable opening 201 of the unit base 200 to the Z2 side are connected to the relay substrate 400. As described above, the cables 126 of the plurality of head main bodies 100 are inserted into the cable openings 201, which open to the Z2 side of the unit base 200, and are connected to the common relay substrate 400, and thereby ink mists are difficult to infiltrate to the side of the nozzle-formed surface 102 through the cable openings 201. Thus, it is possible to decrease an amount of ink attached to the cables 126, the wiring substrate 123 of the head main bodies 100, or the like.

In addition, in the embodiment, the step 234 is provided on the outer side of the first wall portion 231 such that the relay substrate 400 is accommodated in the step 234. Therefore, the relay substrate 400 is less exposed on the Z1 side such that it is possible to decrease an amount of ink mists or the like attached to the relay substrate 400 from the side of the nozzle-formed surface 102. In other words, the first wall portion 231 provided with the step 234 covers the relay substrate 400 on the Z1 side, and thereby the ink is unlikely to be attached to the relay substrate 400.

Further, it is preferable that the relay substrate 400 have a size in the third direction Z which is larger than the height of the step 234 in the third direction Z. In this manner, a portion of the cable opening 201, which opens to the first wall portion 231, that is, an opening on the side in the first direction X, is blocked with the relay substrate 400. Hence, the relay substrate 400 makes it possible to decrease an amount of the ink infiltrated through the cable openings 201. It is needless to say that the step 234, in which the relay substrate 400 is accommodated, is covered with a lid member or the like, and thereby it is possible to decrease the amount of the ink attached to the relay substrate 400. However, the step 234 is covered with the lid member, and thereby there is a concern that the recording head 3 is likely to be increased in size in the first direction X. In the embodiment, the relay substrate 400 is not covered and is exposed in the first direction X, and thereby it is possible to decrease the recording head 3 in size in the first direction X.

As illustrated in FIG. 4, since the unit base 200 of the embodiment holds the plurality of head main bodies 100 which are aligned in the second direction Y, the bottom portion 210 is short in the first direction X, elongates in the second direction Y, and has a substantially rectangular shape. In this respect, the second wall portion 232 of the wall portion 230 is provided in the fourth direction Xa which is inclined with respect to the first direction X. Therefore, the bottom portion 210 has a first projecting portion 217 and a second projecting portion 218 that projects outward from both end portions thereof in the second direction Y, respectively, more than the wall portion 230, such that the first and second projecting portion project to have an eave shape. In other words, the bottom portion 210 has the first projecting portion 217 that more projects outward than the second wall portion 232 on the Y1 side of the second direction Y and the second projecting portion 218 that more projects outward than the second wall portion 232 on the Y2 side of the second direction Y.

As illustrated in FIG. 5, the first projecting portion 217 is provided with a first through-hole 219 that penetrates therethrough in the third direction Z as the lifting/lowering direction of the recording head 3. A first guide shaft 9*a* having the axial direction thereof in the third direction Z is inserted into the first through-hole 219. In addition, a first bearing 220 is provided in the first through-hole 219, so as to be in contact with an outer circumferential surface of the first guide shaft 9*a* and to receive the load of the shaft.

In addition, the second projecting portion 218 is provided with a cylindrical protruding portion 221 that protrudes toward the Z2 side. A second through-hole 222, which penetrates through the protruding portion 221 and the second projecting portion 218 in the third direction Z, is provided inside the protruding portion 221, and a second guide shaft 9*b* having the axial direction thereof in the third direction Z is inserted into the second through-hole 222. In addition, a second bearing 223 and a third bearing 224 are provided in an opening of the second through-hole 222 on the Z1 side and an opening thereof on the Z2 side, respectively, so as to be in contact with an outer circumferential surface of the second guide shaft 9*b* and to receive the load of the shaft. In other words, the second bearing 223 is provided in the opening of the second through-hole 222 on the Z2 side and the third bearing 224 is provided in the opening thereof on the Z1 side. In addition, the second bearing 223 and the third bearing 224 are separately provided in the second through-hole 222. In the second through-hole 222, the load of the second guide shaft 9*b* is received at two positions of the two second bearing 223 and third bearing 224 provided at positions separated in the third direction Z. In other words, in the embodiment, the unit base 200 is supported by the two first and second guide shafts 9*a* and 9*b* provided in the apparatus main body 2, at total three positions of the first bearing 220, the second bearing 223, and the third bearing 224.

Here, the first bearing 220 is provided with a first bearing hole 2201 into which the first guide shaft 9*a* is inserted. In addition, the second bearing 223 is provided with a second bearing hole 2231 into which the second guide shaft 9*b* is inserted, and the third bearing 224 is provided with a third bearing hole 2241 into which the second guide shaft 9*b* is inserted. The first guide shaft 9*a* and the second guide shaft 9*b* of the embodiment have a circular column shape of which a cross section has a circular shape.

In the embodiment, as illustrated in FIG. 4, the first bearing hole 2201 provided in the first bearing 220 has an opening that is an elongate hole. Specifically, the first bearing hole 2201 has an opening shape of an elongate hole having a long axis in a direction along a line L connecting the first guide shaft 9*a* and the second guide shaft 9*b* and having a short axis in a direction perpendicular to the line L in a plane including the first direction X and the second direction Y. For example, examples of shapes of the elongate hole include an elliptical shape, an oval shape, a track shape, and the like. In the embodiment, an opening shape of the first through-hole 219 is the same opening shape as the first bearing hole 2201. In other words, the first through-hole is formed by an elongate hole. In other words, in the embodiment, a bearing provided for each of the plurality of guide shafts 9, that is, the first bearing 220 provided for the first guide shaft 9*a* and the second bearing 223 and the third bearing 224 provided for the second guide shaft 9*b*, is provided. The first bearing 220, the second bearing 223, and the third bearing 224 have intervals different for each guide shaft 9 in a direction along a line connecting the plurality of guide shafts 9, that is, the line L connecting the first guide shaft 9*a* and the second guide shaft 9*b*.

In this respect, the second bearing hole 2231 and the third bearing hole 2241 are provided to have an opening that is formed by a circular hole. In other words, the opening shapes of the second bearing hole 2231 and the third bearing hole 2241 are substantially a circle. In the embodiment, an opening shape of the second through-hole 222 is the same opening shape as the second bearing hole 2231 and the third bearing hole 2241. In other words, the second through-hole is formed by a circular hole.

As described above, the second bearing hole 2231 and the third bearing hole 2241 are the circular holes, and the first bearing hole 2201 is the elongate hole. In this manner, when the recording head 3 is positioned with respect to the first guide shaft 9*a* and the second guide shaft 9*b*, the second guide shaft 9*b* is inserted into the second bearing hole 2231 and the third bearing hole 2241 of the recording head 3 such that it is possible to perform positioning in the first direction X and the second direction Y, and the first guide shaft 9*a* is inserted into the first bearing hole 2201 such that it is possible to perform positioning in a rotating direction of the recording head 3 around the second guide shaft 9*b*. The first bearing hole 2201 is the elongate hole of which the long axis is coincident with the line L, and thereby it is possible to reliably insert the first guide shaft 9*a* and the second guide shaft 9*b* into the first bearing hole 2201 and both of the second bearing hole 2231 and the third bearing hole 2241, respectively, even when there is an error in the position or dimension of the first guide shaft 9*a* and the second guide shaft 9*b* or an error in the position or dimension of the first bearing hole 2201, the second bearing hole 2231, and the third bearing hole 2241. Incidentally, in a case where the first bearing hole 2201 and both of the second bearing hole 2231 and the third bearing hole 2241 are the circular holes, it is not possible to insert both of the first guide shaft 9*a* and the second guide shaft 9*b* into the first bearing hole 2201 and the second bearing hole 2231 and the third bearing hole 2241 due to the error in the position or dimension. In addition, even when the insertion is performed, there is a deviation in clearance between the inner surfaces of the first bearing hole 2201 and both of the second bearing hole 2231 and the third bearing hole 2241 and the outer circumferences of the first guide shaft 9*a* and the second guide shaft 9*b*, and thus there is a concern that it will be difficult to cause the recording head 3 to move in the third direction Z. In the embodiment, the first bearing hole 2201 is the elongate hole and the second bearing hole 2231 and the third bearing hole 2241 are the circular hole. In this manner, it is possible to reduce the deviation in the clearance between the inner surfaces of the first bearing hole 2201 and both of the second bearing hole 2231 and the third bearing hole 2241 and the first guide shaft 9*a* and the second guide shaft 9*b*, and thus it is possible to position the recording head 3 with respect to the guide shafts 9 with high accuracy and to smoothly cause the recording head 3 to move in the axial direction of the guide shafts 9.

Figure 16:
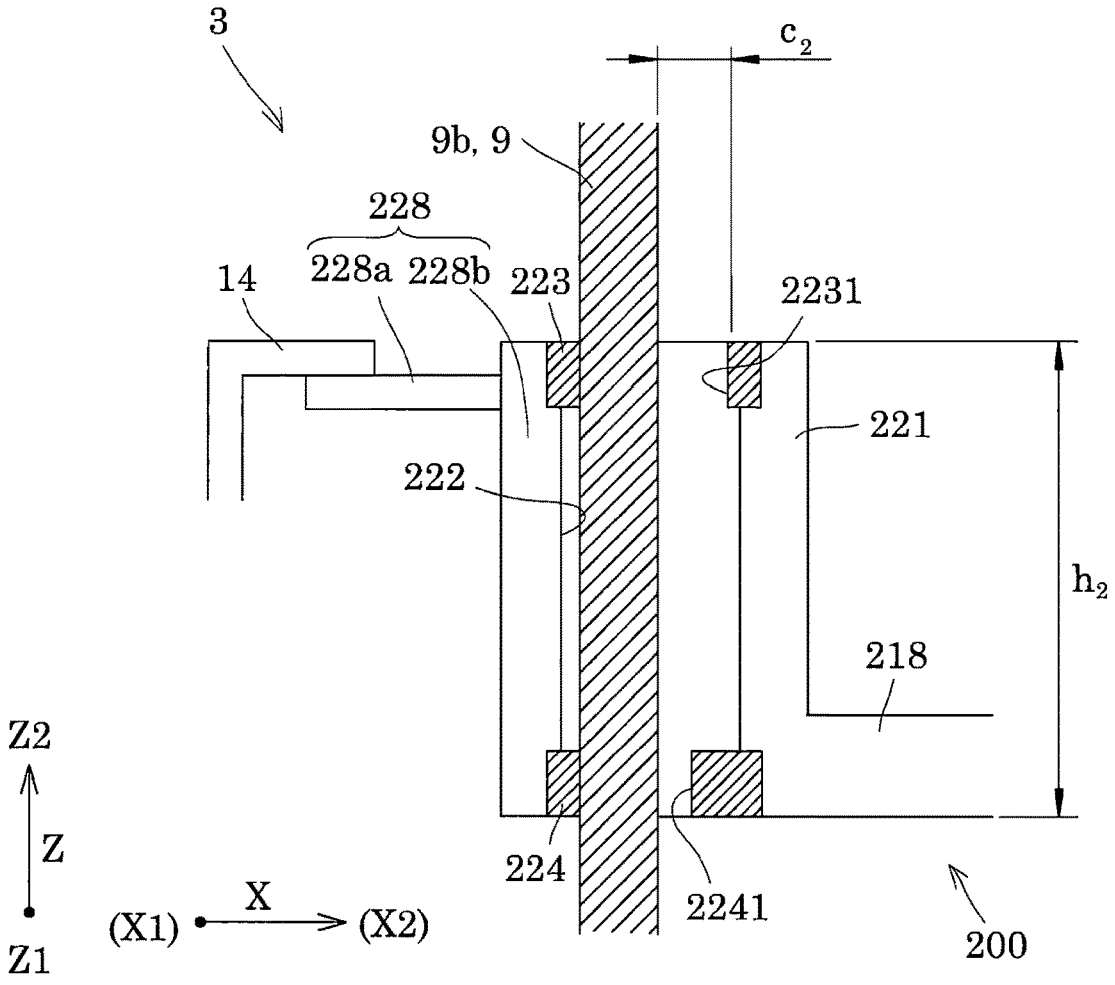
FIG. 16 is a cross-sectional view of main parts illustrating the lifted/lowered state of the recording head according to Embodiment 1.

In addition, in the embodiment, the centers of the second bearing hole 2231 and the third bearing hole 2241 is disposed at positions shifted from each other when viewed in plan view in the third direction Z. As will be described below in detail, this is performed to adjust an angle of the second bearing 223 and the third bearing 224 when the second bearing 223 and the third bearing 224 tilt to come into contact with the second guide shaft during the restraint of the recording head 3 from floating to the Z2 side due to the load of the cap 15. As illustrated in FIG. 5 and FIG. 16 to be described below in detail, the second bearing hole 2231 and the third bearing hole 2241 have the center which is shifted in the second direction Y and are provided to have the center at the same position in the first direction X. In this manner, it is possible to restrain the recording head 3 from tilting to the first direction X.

In the embodiment, the first bearing 220, the second bearing 223, and the third bearing 224 are disposed at overlap positions with the head main bodies 100 in the second direction Y as the alignment direction of the head main bodies 100. In this manner, it is possible to decrease the unit base 200 in size in the first direction X. In addition, since the first guide shaft 9*a* and the second guide shaft 9*b* which are the two guide shafts 9 can support both end portions of the unit base 200 in the second direction Y as the longitudinal direction thereof, it is possible to restrain the unit base 200 from tilting with respect to the third direction Z as the axial direction of the first guide shaft 9*a* and the second guide shaft 9*b*. Incidentally, in order to dispose the first bearing 220, the second bearing 223, and the third bearing 224 at the overlap positions with the head main bodies 100 in the first direction X, the unit base 200 needs to be provided with a space for the first through-hole 219 and the second through-hole 222, and thus the unit base 200 is likely to be increased in size in the first direction X.

In the embodiment, as illustrated in FIG. 5, the protruding portion 221, which more projects to the Z2 side than the bottom portion 210, is provided, and the second bearing 223 and the third bearing 224 are provided in the second through-hole 222 of the protruding portion 221. In this manner, it is possible to dispose the second bearing 223 and the third bearing 224 at positions which are separated from each other in the third direction Z. Therefore, the entire bottom portion 210 does not need to be thick in the third direction Z, and thus it is possible to less increase the weight of the unit base 200.

In addition, in the embodiment, the two guide shafts 9 of the first guide shaft 9*a* and the second guide shaft 9*b* are positioned by three positions of the first bearing 220, the second bearing 223, and the third bearing 224. In other words, the first guide shaft 9*a* is positioned by one position of the first bearing 220, and the second guide shaft 9*b* is positioned by the two positions of the second bearing 223 and the third bearing 224. In this manner, it is possible to restrain the unit base 200 from tilting with respect to the first guide shaft 9*a* and the second guide shaft 9*b*, particularly the tilt in a direction in which the unit base rotates toward the first direction X. There is no particular limitation to the number of bearings as long as the two shafts of the first guide shaft 9*a* and the second guide shaft 9*b* are positioned by three or more bearings. For example, there may be employed a configuration in which a total of four bearings are provided with respect to the two first and second guide shafts 9*a* and 9*b*, with two bearings ore each guide shaft. However, it is difficult to adjust a clearance, a tilt, or the like of the first guide shaft 9*a* and the second guide shaft 9*b* in each of the four bearings, and thus there is a concern that a deviation in the clearance of the bearings with the first guide shaft 9*a* and the second guide shaft 9*b* will occur and it will be difficult to cause the recording head 3 to move in the third direction Z. In the embodiment, the three bearings of the first bearing 220, the second bearing 223, and the third bearing 224 are provided with respect to the two shafts of the first guide shaft 9*a* and the second guide shaft 9*b*, and thereby it is possible to easily adjust the clearance between the first guide shaft 9*a* and the first bearing 220 and the clearance between the second guide shaft 9*b* and the second bearing 223 and the third bearing 224 such that it is possible to cause the recording head 3 to smoothly move with respect to the first guide shaft 9*a* and the second guide shaft 9*b* in the third direction Z. In addition, three or more bearings may be provided with respect to one shaft; however, similarly, it is difficult to relatively position the three or more bearings, and the recording head 3 is difficult to smoothly move.

Further, as illustrated in FIGS. 3 and 7, the first projecting portion 217 is provided with a first contact portion 226 having the first contact surface 225 on the Z1 side. The first contact portion 226 has a side wall 226*b* provided to project from the first projecting portion 217 toward Z2 and a first eave portion 226*a* that projects to have an eave shape toward the X1 side from a projecting end portion of the side wall 226*b* on the Z2 side. A surface of the first eave portion 226*a* on the Z1 side is the first contact surface 225. In other words, the first contact portion 226 is provided with the first eave portion 226*a* on the end portion of the side wall 226*b* on the Z2 side, and thereby it is possible to dispose the first contact surface 225 at a position more separated from the nozzle-formed surface 102 of the recording head 3 on the Z2 side.

In addition, the first contact portion 226 is provided with a first rib 226*c* and a second rib 226*d* that reinforce the fixing to the bottom portion 210. The first rib 226*c* and the second rib 226*d* are formed by a plate-like member connected to a surface of the side wall 226*b* on the X2 side and to the surface of the bottom portion 210 on the Z2 side. The first contact portion 226 is reinforced with the first rib 226*c* and the second rib 226*d*.

The first contact portion 226 is integrally formed with the unit base 200. The first contact portion 226 is integrally formed with the unit base 200, and thereby the stiffness of the first contact portion 226, particularly, the stiffness of the first eave portion 226*a*, is increased.

The second projecting portion 218 is provided with a second contact portion 228 having the second contact surface 227 on the Z1 side. The second contact portion 228 is provided with a second eave portion 228*a* provided to be continuous from an outer circumference of the protruding portion 221 at a position separated from the bottom portion 210 on the Z2 side and to project to have an eave shape toward the X1 side. Incidentally, the protruding portion 221 is provided to more project than the second eave portion 228*a* on the Z2 side. A surface of the second eave portion 228*a* on the Z1 side is the second contact surface 227.

In addition, the second contact portion 228 has a reinforcement portion 228*b* provided between the second eave portion 228*a*, the outer circumferential surface of the protruding portion 221, and the surface of the bottom portion 210 on the Z2 side. The second eave portion 228*a* is reinforced by the reinforcement portion 228*b*.

In addition, in the embodiment, the second contact portion 228 and the protruding portion 221 are integrally formed with the unit base 200. The second contact portion 228 and the protruding portion 221 are integrally formed with the unit base 200, and thereby the stiffness of the second contact portion 228 and the protruding portion 221, particularly, the stiffness of the second eave portion 228*a*, is increased.

A lifting/lowering mechanism is caused to come into contact with both of the first contact surface 225 of the first contact portion 226 and the second contact surface 227 of the second contact portion 228 such that the lifting/lowering mechanism presses the first contact surface 225 and the second contact surface 227 in the third direction Z. In this manner, it is possible to lift and lower the recording head 3 along the first guide shaft 9*a* and the second guide shaft 9*b* in the third direction Z.

Figure 8:
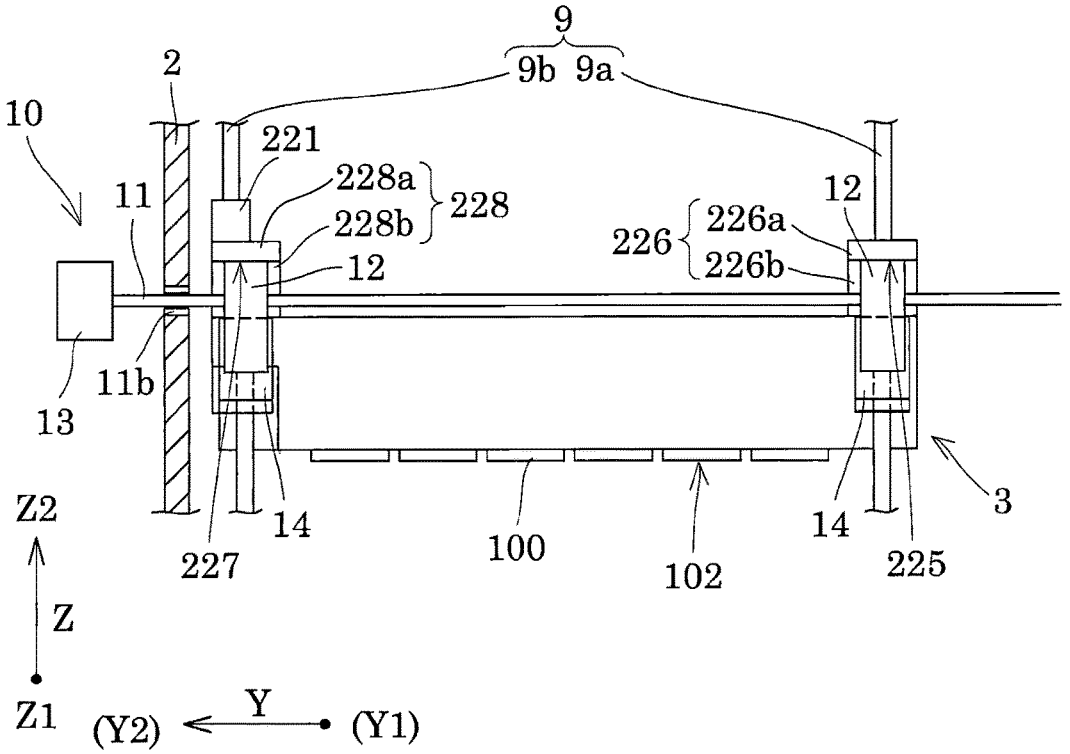
FIG. 8 is a front view of the recording head and a lifting/lowering mechanism according to Embodiment 1.
Figure 9:
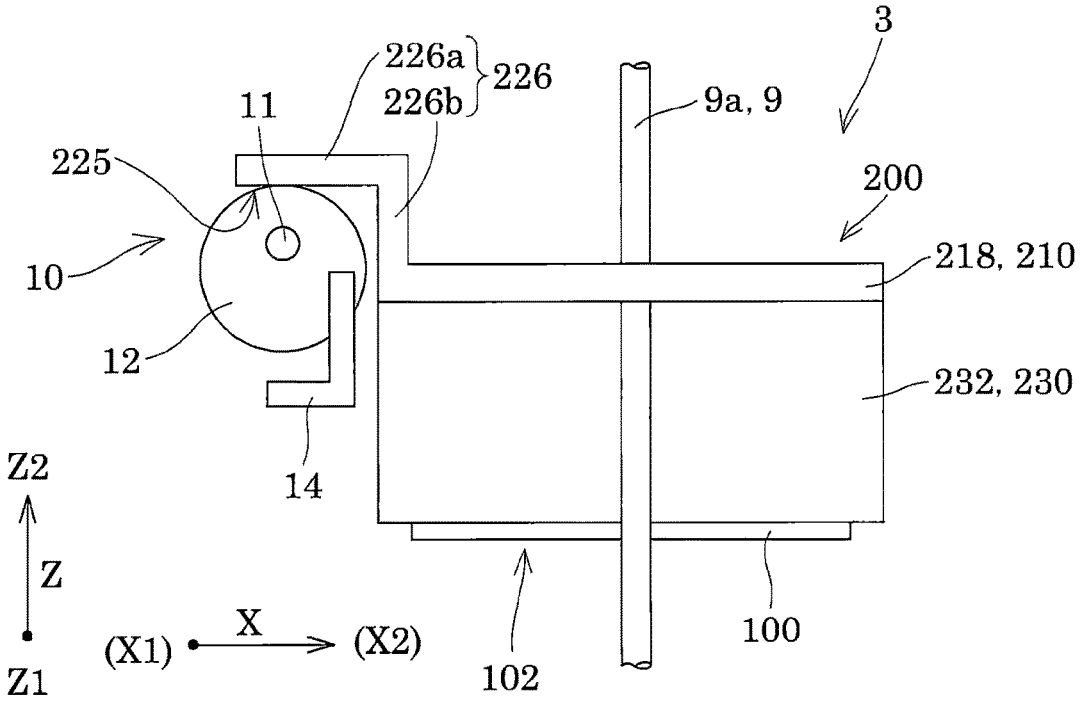
FIG. 9 is a side view of the recording head and the lifting/lowering mechanism according to Embodiment 1.
Figure 10:
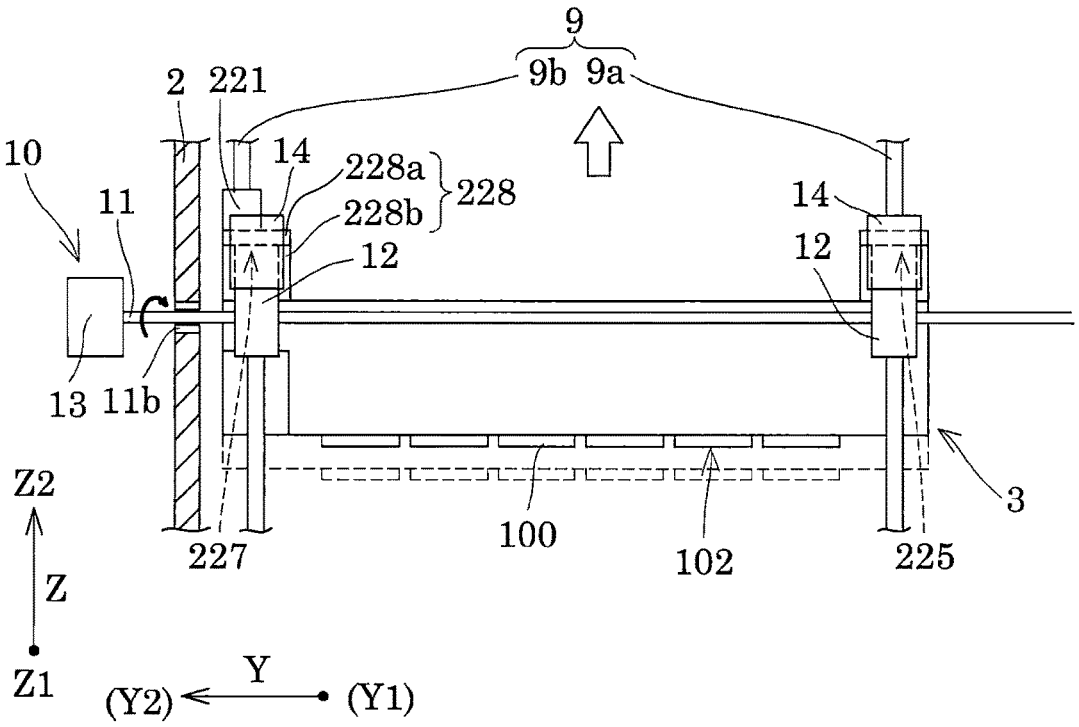
FIG. 10 is a front view of the recording head and the lifting/lowering mechanism according to Embodiment 1.
Figure 11:
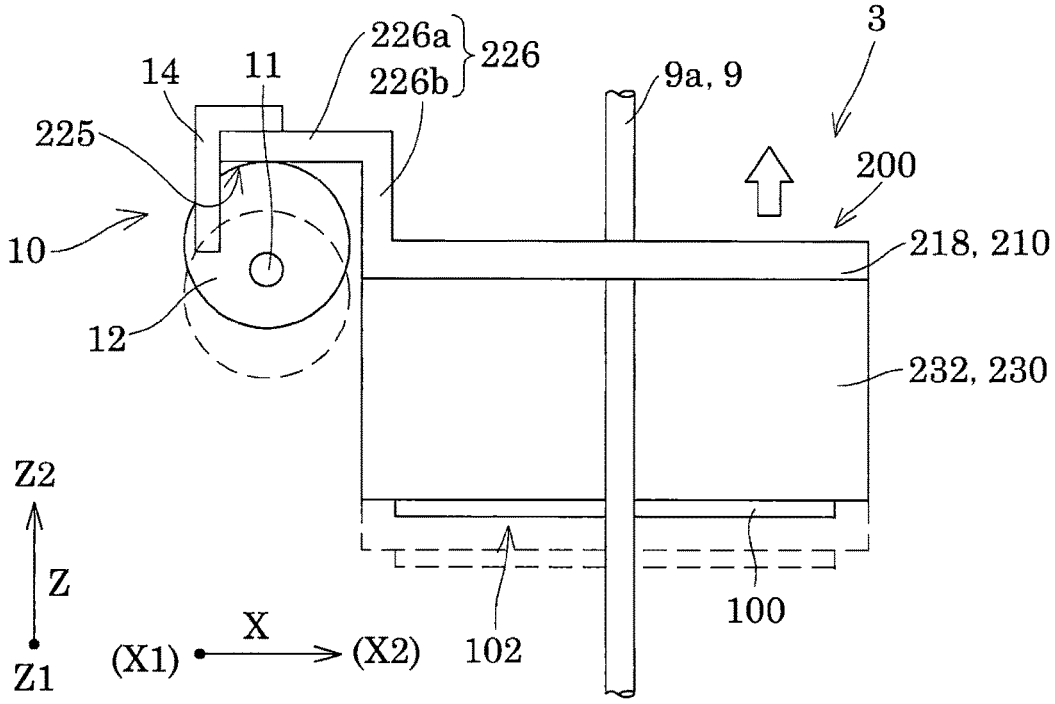
FIG. 11 is a side view of the recording head and the lifting/lowering mechanism according to Embodiment 1.

Here, the lifting/lowering mechanism 10 of the embodiment is further described with reference to FIGS. 8 to 11. FIGS. 8 and 10 are front views of the ink jet type recording apparatus, which illustrates the lifting/lowering mechanism. FIGS. 9 and 11 are side views of the ink jet type recording apparatus, which illustrates the lifting/lowering mechanism.

As illustrated in FIGS. 8 to 11, the lifting/lowering mechanism 10 includes a rotary shaft 11, which is rotatably held in the apparatus main body 2, two eccentric cams 12 fixed to the rotary shaft 11, and a drive unit 13 such as a motor which rotatably drives the rotary shaft 11 around the axial direction.

The eccentric cams 12 are disposed on the first contact surface 225 and the second contact surface 227 on the Z1 side, respectively, and the first contact surface 225 and the second contact surface 227 are brought into contact with the two eccentric cams 12 in the third direction Z due to the own weight of the recording head 3. The rotary shaft 11 is caused to rotate by the drive unit 13 from a state illustrated in FIGS. 8 and 9, and thereby the two eccentric cams 12 press the first contact surface 225 and the second contact surface 227, respectively, on the Z2 side as illustrated in FIGS. 10 and 11. In this manner, it is possible to cause the recording head 3 to move to the Z2 side. In addition, it is possible to cause the eccentric cams 12 to rotate from a position on the Z2 side illustrated in FIGS. 10 and 11, and thereby it is possible to cause the recording head 3 to move to the Z1 side illustrated in FIGS. 8 and 9.

As described above, the first contact surface 225 and the second contact surface 227 of the recording head 3, which are provided to project to the X1 side in the first direction X, come into contact with the eccentric cams 12 of the lifting/lowering mechanism 10, and thereby it is possible to lift and lower the recording head 3 to an arbitrary position in the third direction Z. The unit base 200 is provided with the first contact surface 225 and the second contact surface 227 with which the lifting/lowering mechanism 10 comes into contact, and thereby it is possible to position the unit base 200 in the third direction Z as the lifting/lowering direction, that is, to position the nozzle-formed surface 102 of the head main body 100 held in the unit base 200, with high accuracy. In this manner, it is possible to adjust a gap between the recording sheet S and the nozzle-formed surface 102 with high accuracy and it is possible to reduce a shift of a landing position of an ink droplet or the like such that it is possible to improve the print quality. Incidentally, it is not preferable that the eccentric cams 12 come into contact with the unit base 200 and a roller be provided to be driven along with the rotation of the eccentric cams 12, because variations in a components such as a roller are likely to occur, and the accuracy of the positioning of the recording head 3 in the third direction Z is likely to be degraded.

In addition, in the embodiment, the eccentric cams 12, which come into contact with the first contact surface 225 and the second contact surface 227, respectively, are fixed to the same shaft, that is, to the single rotary shaft 11. Therefore, compared to a case where the rotary shaft 11 is provided for each eccentric cam 12, it is possible to restrain a positional shift of the two eccentric cams 12 in the rotating direction, and it is possible to restrain the recording head 3 from tilting, that is, the tilt in the rotating direction in a plane including the second direction Y and the third direction Z such that it is possible to position the nozzle-formed surface 102 of the recording head 3 by the lifting/lowering mechanism 10 with high accuracy. Incidentally, in the case where the rotary shaft 11 is provided for each of the two eccentric cams 12, there is a concern that rotating angles of the two rotary shafts 11 which are linked to each other will be different from each other due to the variations in the component such as a gear or a belt that links the different rotary shafts 11 to each other. When the rotating angles of the two rotary shafts 11 are different from each other, there are variations in a pressing amount of the eccentric cams 12 that press the first contact surface 225 and the second contact surface 227 and then, the nozzle-formed surface 102 is likely to tilt. In addition, since the two eccentric cams 12 are provided on the single rotary shaft 11, it is possible to easily adjust the tilt of the recording head 3 by just tilting the rotary shaft 11.

In addition, in the embodiment, as described above, the first eave portion 226*a* having the first contact surface 225 and the second eave portion 228*a* having the second contact surface 227 are integrally provided with the unit base 200. In this manner, it is possible to increase the stiffness of the first eave portion 226*a* and the second eave portion 228*a*, and it is possible to restrain a positional shift due to the deformation or the like of the first contact surface 225 and the second contact surface 227 such that it is possible to position the unit base 200 in the third direction Z as the lifting/lowering direction with higher accuracy.

Further, in the embodiment, the first contact surface 225 and the second contact surface 227 are provided in the recording head 3 in the first direction X. Therefore, compared to a case where the first contact surface 225 and the second contact surface 227 are provided on both sides in the second direction Y, it is possible to decrease the recording head 3 in size in the second direction Y. Similarly, in the embodiment, since the first contact surface 225 and the second contact surface 227 are provided to be coincident in the positions thereof and the lifting/lowering mechanism 10 is provided in the first direction X as the direction orthogonal to the alignment direction of the head main bodies 100, it is possible to decrease the ink jet type recording apparatus 1 in size in the second direction Y, compared to a case where the lifting/lowering mechanisms 10 are provided on both sides in the second direction Y.

In addition, in the embodiment, the first contact surface 225 and the second contact surface 227 are provided only on the X1 side of the first direction X. Therefore, compared to a case where contact surfaces which come into contact with the lifting/lowering mechanism 10, are provided on both sides of the X1 side and the X2 side, it is possible to decrease the recording head 3 in size in the first direction X. It is needless to say that, similarly, since the lifting/lowering mechanism 10 is also provided only on the X1 side, it is possible to decrease the ink jet type recording apparatus 1 in size in the first direction X.

Figure 12:
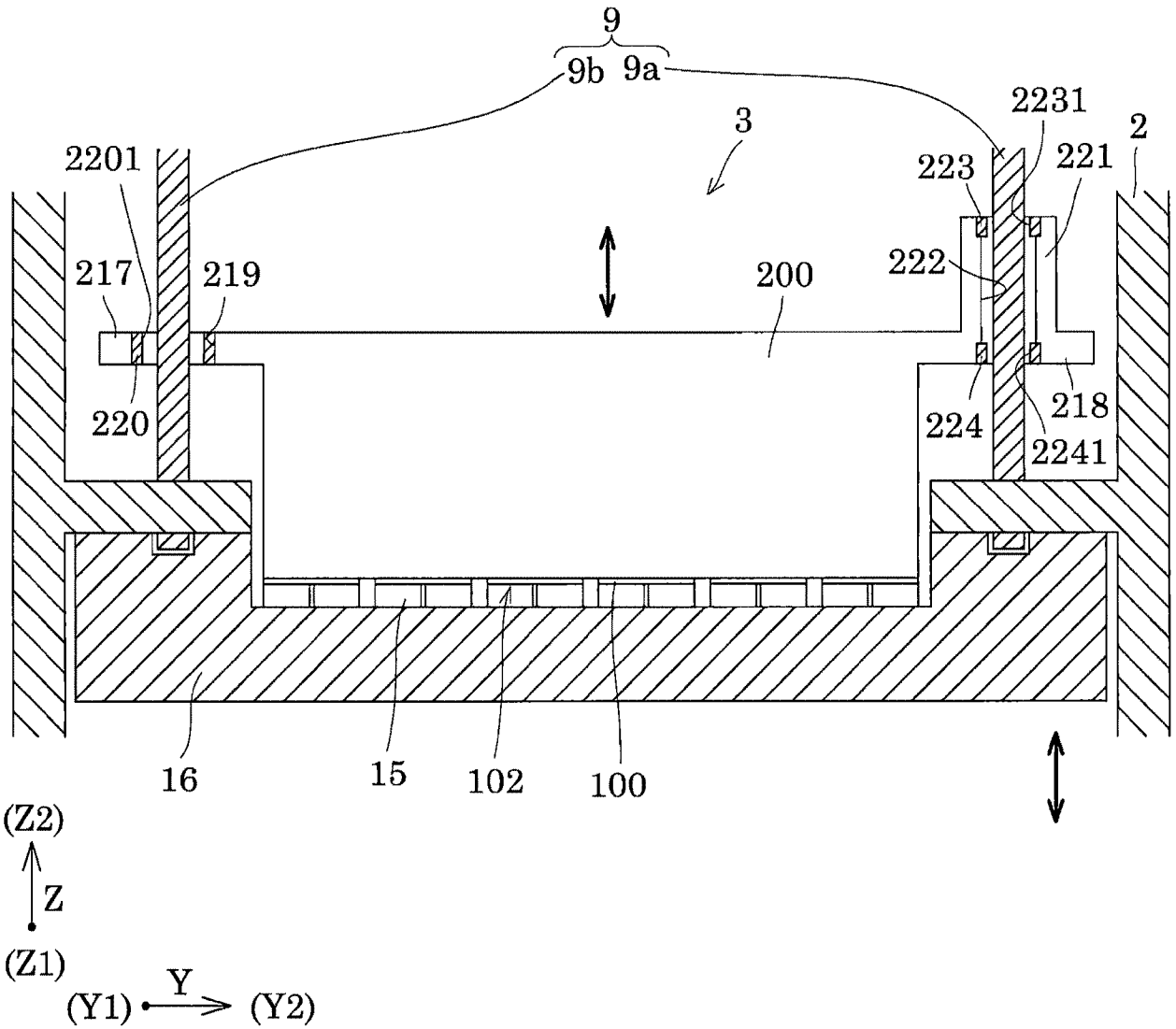
FIG. 12 is a cross-sectional view of main parts illustrating a cap according to Embodiment 1.

In addition, the apparatus main body 2 includes the cap 15 which is lifted and lowered in the third direction Z as the direction in which the recording head 3 is lifted and lowered, and the cap covers the nozzle-formed surface 102 of the recording head 3. Here, the cap 15 is described with reference to FIG. 12. FIG. 12 is a cross-sectional view of main parts illustrating the recording head and the cap.

As illustrated in FIG. 12, the caps 15 are aligned on a surface of a support member 16 on the Z2 side, which is provided on the side of the nozzle-formed surface 102 of the recording head 3 and the caps come into contact with the nozzle-formed surface 102 of the recording head 3. The support member 16 is provided to be movable in the same direction as the lifting/lowering direction of the recording head 3, that is, the third direction Z, by a moving unit not illustrated, and the support member 16 moves toward the nozzle-formed surface 102 at a predetermined timing. In this manner, the cap 15 is caused to come into contact with the nozzle-formed surface 102.

For example, the cap 15 held in the support member 16 has a size to cover some nozzle openings 101 of the single head main body 100 fixed to the recording head 3. Specifically, as illustrated in FIG. 5, in the embodiment, six head chips 110 are held in the single head main body 100, and the cap 15 has a size to cover the nozzle openings 101 of three head chips 110 of the six head chips 110, for example. As described above, one cap 15 has the size to cover some nozzle openings 101 of the one head main body 100, and thereby a load obtained when the cap 15 comes into contact with the nozzle-formed surface 102 is increased such that it is possible to increase the sealing performance. The sealing performance between the cap 15 and the nozzle-formed surface 102 is improved, and thereby it is possible to perform suctioning of the inside of the cap 15 such that it is possible to normally perform a suction operation of suctioning the ink from the nozzle openings 101. In addition, the sealing performance between the cap 15 and the nozzle-formed surface 102 is improved, and thereby it is possible to decrease an amount of inks evaporating from the nozzle openings 101.

In the embodiment, one cap 15 has a size to cover some nozzle openings 101 of one head main body 100; however, the configuration is not limited thereto, and one cap 15 may have a size to cover all of the nozzle openings 101 of the head main body 100, or one cap 15 may have a size to cover the nozzle openings 101 of the plurality of head main bodies 100. However, as an area which is covered with the cap 15 is increased, it is difficult to increase the load applied to the nozzle-formed surface 102.

When the cap 15 comes into contact with the nozzle-formed surface 102 of the recording head 3, the recording head 3 floats to the Z2 side due to the contact with the cap 15 in a state in which the recording head 3 comes into contact with the eccentric cams 12 due to the own weight of the recording head. Therefore, when the cap 15 comes into contact with the nozzle-formed surface, the restrainer 14 is provided to come into contact with the surface of the recording head 3 on the Z2 side and to prevent the floating of the recording head 3 on the Z2 side.

Here, the restrainer 14 is described with reference to FIGS. 8 to 11. As illustrated in FIGS. 9 and 11, the restrainer 14 are formed by curved plate-like members having base end portions that are fixed to the eccentric cams 12 and front ends that come into contact with surfaces of the first eave portion 226*a* and the second eave portion 228*a* on a side opposite to the first contact surface 225 and the second contact surface 227, due to the rotation of the eccentric cam 12. As illustrated in FIG. 9, in a case where the eccentric cam 12 is positioned on the first contact surface 225 on the Z1 side, the front end of the restrainer 14 is positioned on the Z1 side and the eccentric cam 12 rotates at an angle of about 180 degrees, as illustrated in FIG. 11. In this manner, the eccentric cam 12 pushes up the first contact surface 225 to the Z2 side, the front end of the restrainer 14 rotates to the Z2 side along with the rotation of the eccentric cam 12, and the restrainer 14 comes into contact with a surface of the first eave portion 226*a* on the side opposite to the first contact surface 225. In addition, as illustrated in FIGS. 8 and 10, since the restrainers 14 are provided on both sides of the two eccentric cams 12, the restrainer 14 also comes into contact with a surface on the side of the second eave portion 228*a* on the side opposite to the second contact surface 227. In this manner, the restrainer 14 restrain the recording head 3 from floating to the Z2 side at two positions of the first eave portion 226*a* and the second eave portion 228*a*.

As described above, the restrainers 14 are provided to come into contact with the surfaces of the first eave portion 226*a* and the second eave portion 228*a* on the side opposite to the first contact surface 225 and the second contact surface 227 along with the rotation of the eccentric cams 12, and thereby there is no need to provide a drive unit such as a drive motor that independently drives the restrainer 14 such that it is possible to decrease the size and costs. In addition, since the two restrainers 14 are provided to the two eccentric cams 12 provided on the same shaft, that is, the single rotary shaft 11, there is no need to provide a unit that individually drives each of the two restrainers 14 such that it is possible to decrease the size and costs.

Figure 13:
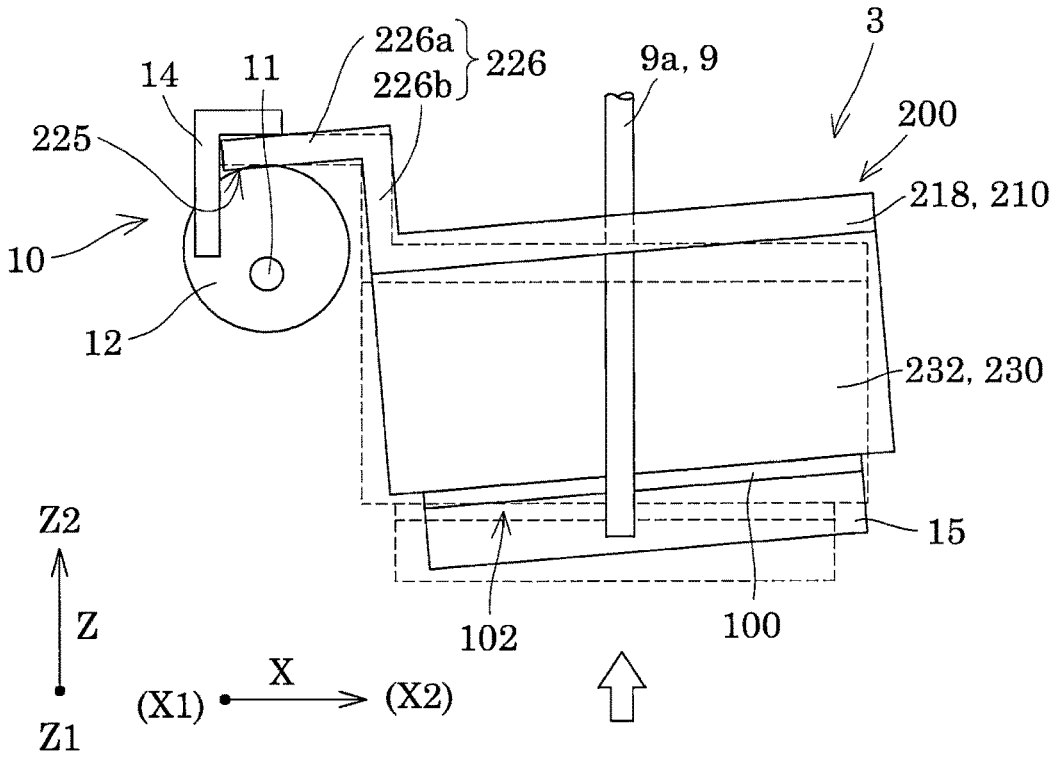
FIG. 13 is a side view illustrating a capping state of the recording head according to Embodiment 1.

As illustrated in FIG. 13, in a state in which the restrainer 14 restrain the recording head 3 from floating to the Z2 side, the cap 15 comes into contact with the nozzle-formed surface 102 of the recording head 3 with a predetermined load. At this time, since the restrainers 14 come into contact with the surface of the first eave portion 226*a* on the side opposite to the first contact surface 225 and the surface of the second eave portion 228*a* on the side opposite to the second contact surface 227, the restrainers 14 restrain the recording head 3 from floating at a position shifted from the center of the cap 15 to the X1 side in the first direction X. In other words, since the cap 15 comes into contact with the nozzle-formed surface 102 of the head main body 100 so as to cover the nozzle openings 101, the center of the cap 15 is coincident with the center of a region of the head main body 100 with which the cap 15 comes into contact. In this respect, since the first eave portion 226*a* and the second eave portion 228*a* of the recording head 3 which is restrained by the restrainer 14 are provided to have the eave shape and to more project to the X1 side than the bottom portion 210 to which the head main body 100 of the unit base 200 is fixed, the position, at which the restrainer 14 restrain the recording head 3 from floating to the Z2 side is a position shifted from the center of the cap 15.

As described above, the recording head 3, which is restrained by the restrainer 14 at the position shifted from the center of the cap 15, comes into contact with the first guide shaft 9*a* and the second guide shaft 9*b* in a tilting state due to the load of the cap 15 that comes into contact with the nozzle-formed surface 102. In other words, the first contact surface 225 and the second contact surface 227 are provided to project to the X1 side. Therefore, when the cap 15 comes into contact with the recording head 3 and applies the load thereto, the X2 side of the recording head 3 is lifted to the Z2 direction, and the recording head is likely to have a tilt in a rotating direction to the first direction X in which the X1 side thereof is lowered to the Z1 direction. As described above, the recording head 3 tilts to come into contact with the guide shafts 9, and thereby the load of the cap 15 can be received by the restrainer 14 and the guide shafts 9. In other words, as a capping method of the embodiment, in a state in which the restrainer 14, which performs restraint at the position shifted from the center of the cap 15, restrains the floating of the recording head 3, the cap 15 comes into contact with the nozzle-formed surface 102, and thereby the recording head 3 tilts to come into contact with the guide shafts 9. Therefore, the load of the cap 15 is received by not only the restrainer 14 but also the guide shafts 9, and thereby it is possible to restrain the recording head 3 from floating to the Z2 side even when a force, by which the restrainer 14 restrains the recording head 3 from floating, is weak. Hence, it is possible to use the material having relatively low stiffness as the restrainer 14, and it is possible to restrain the restrainer 14, the lifting/lowering mechanism 10 provided with the restrainer 14, or the like from being deformed or damaged.

In addition, the recording head 3 comes into contact with the guide shafts 9 in the tilting state, and thereby the restrainer 14 and the two guide shafts 9 can receive the load of the cap 15. Therefore, it is possible to increase the load produced when the cap 15 comes into contact with the nozzle-formed surface 102. As described above, the load produced when the cap 15 comes into contact with the nozzle-formed surface 102 is increased, and thereby it is possible to increase sealing performance between the cap 15 and the nozzle-formed surface 102 such that it is possible to reliably perform a suction operation via the cap 15. In addition, it is possible to increase the load produced when the cap 15 comes into contact with the nozzle-formed surface 102, and then it is possible to increase the sealing performance between the cap 15 and the nozzle-formed surface 102 such that it is possible to restrain ink from evaporating from the nozzle openings 101.

The center of the cap 15 means the center of the load applied when the cap 15 comes into contact with the nozzle-formed surface 102 and presses the nozzle-formed surface. Incidentally, when the restrainer 14 is provided at the center of the cap 15, the recording head 3 does not tilt with respect to the guide shafts 9, and thus the restrainer 14 needs to receive the entire load of the cap 15. Therefore, a material having high stiffness has to be used as the restrainer 14, and there is a concern that the restrainer 14 is increased in size and the lifting/lowering mechanism 10 provided with the restrainer 14 will be broken. In addition, the restrainer 14 is provided at the position shifted from the center of the cap 15. This means that, in a case where one restrainer 14 is provided, the restrainer 14 is provided at the position shifted from the center of the load of the cap 15, and that, in a case where a plurality of restrainers 14 are provided, the center of the load restrained by the two restrainers 14 is the position shifted from the center of the cap 15. For example, in a case where the two restrainers 14 are provided as in the embodiment, the center of the load restrained by the plurality of restrainers 14 is the position of the center of a line connecting the two restrainers 14. In other words, the center of the load restrained by the plurality of restrainers 14 is the position at the shortest distance from the plurality of restrainers 14, and thereby the position may be the position shifted from the center of the load of the cap 15.

Figure 14:
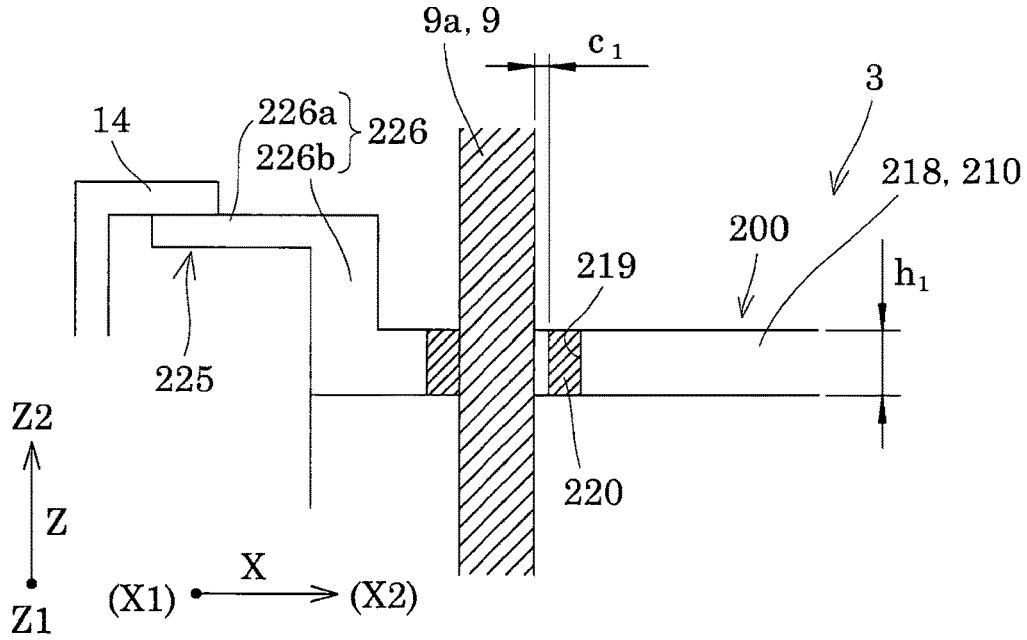
FIG. 14 is a cross-sectional view of main parts illustrating a lifted/lowered state of the recording head according to Embodiment 1.
Figure 15:
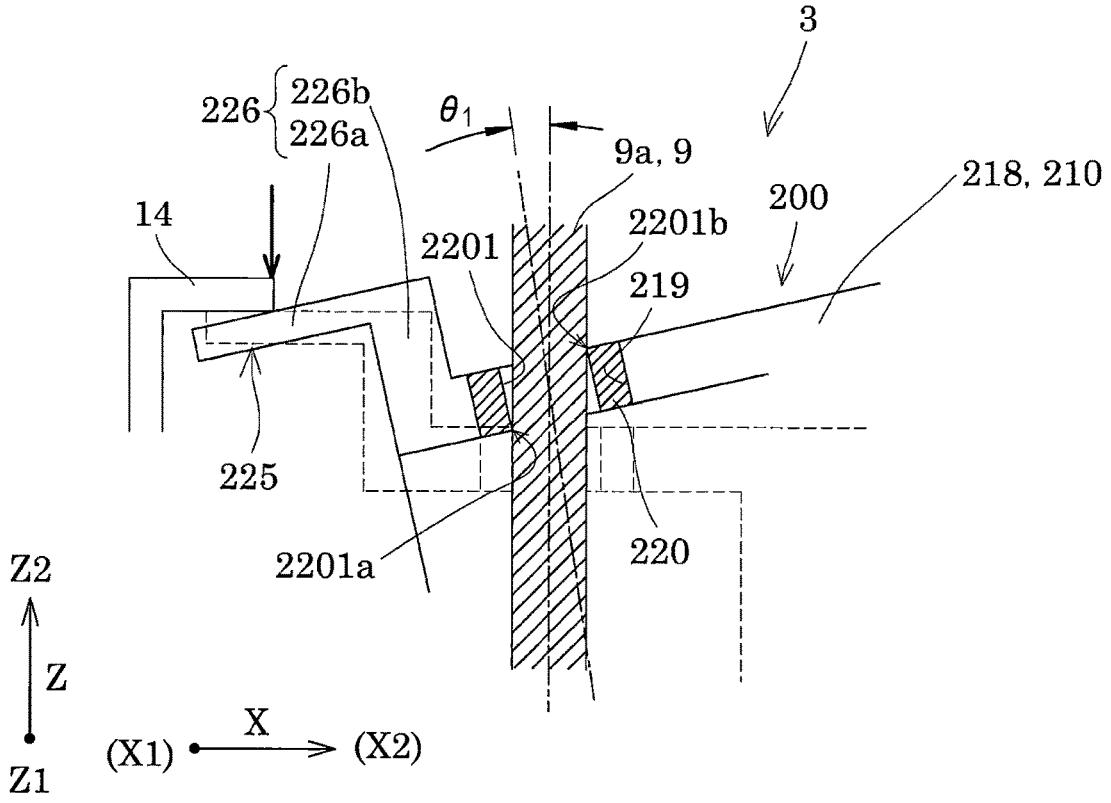
FIG. 15 is a cross-sectional view of main parts illustrating a tilting state of the recording head according to Embodiment 1.
Figure 17:
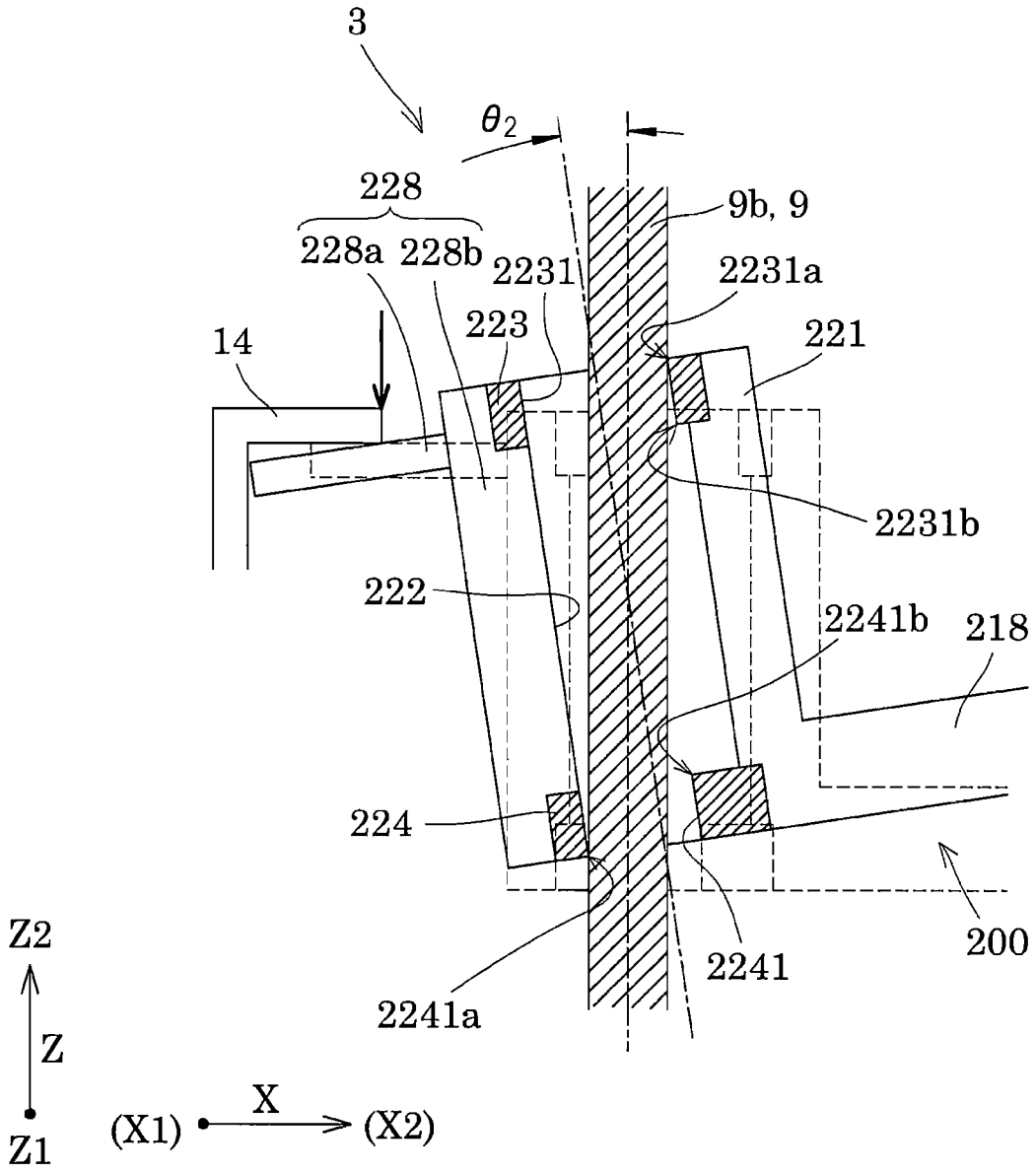
FIG. 17 is a cross-sectional view of main parts illustrating the tilting state of the recording head according to Embodiment 1.

Here, a tilting angle of the recording head 3, which is restrained by the restrainer 14, with respect to the guide shafts 9 is described with reference to FIGS. 14 to 17. FIGS. 14 and 15 are cross-sectional views taken along line XIV-XIV, XV-XV in FIG. 4 and illustrate a tilting angle of the recording head. FIGS. 16 and 17 are cross-sectional views taken along line XVI-XVI, XVII-XVII in FIG. 4 and illustrate a tilting angle of the recording head.

In the embodiment, as illustrated in FIGS. 15 and 17, when the recording head 3 restrained by the restrainer 14 tilts due to the load of the cap 15, the tilting angles of the recording head 3 with respect to both of the first guide shaft 9*a* and the second guide shaft 9*b* are set to the same angle.

Specifically, as illustrated in FIG. 14, in a state in which the restrainer 14 does not restrain the recording head 3 from floating to the Z1 side, that is, a state in which the recording head 3 is provided to be liftable and lowerable in the third direction Z by the lifting/lowering mechanism 10, a state of the recording head 3 with respect to the first guide shaft 9*a* means a non-tilting state. In this respect, as illustrated in FIG. 15, when the cap 15 comes into contact with the recording head 3 and the load is applied thereto in a state of being restrained by the restrainer 14, the first bearing 220 of the recording head 3 tilts to come into contact with the first guide shaft 9*a*. In the embodiment, a surface of the first guide shaft 9*a* on the X1 side of the first direction X comes into contact with an opening edge portion 2201*a* of the first bearing hole 2201 of the first bearing 220 on the Z1 side, and a surface of the first guide shaft 9*a* on the X2 side comes into contact with an opening edge portion 2201*b* of the first bearing hole 2201 on the Z2 side. In this manner, the recording head 3 comes into contact with the first guide shaft 9*a* in the tilting state. The state in which the recording head 3 comes into contact with the first guide shaft 9*a* in the tilting state means that the first bearing hole 2201 and the first guide shaft 9*a* come into contact with each other in a state in which the axial direction (penetrating direction) of the first bearing hole 2201 tilts with respect to the axial direction of the first guide shaft 9*a*. In addition, in the embodiment, the state in which the recording head 3 comes into contact with the first guide shaft 9*a* in the tilting state means a state in which one surface side of the first guide shaft 9*a* comes into contact with one portion of the opening edge portion 2201*a* or 2201*b* of the first bearing hole 2201 on the Z1 side and the Z2 side and the other surface side of the first guide shaft 9*a* comes into contact with the other portion of the opening edge portion 2201*a* or 2201*b* of the first bearing hole 2201 on the Z1 side and the Z2 side in the first direction X as the tilting direction of the recording head 3. In other words, in order for the first guide shaft 9*a* to receive the load of the recording head 3, which is applied by the cap 15, the recording head 3 tilts to come into contact with the first guide shaft 9*a*. Therefore, in a state in which only one side surface of the two surfaces of the first guide shaft 9*a*, which are provided on both sides with the axis of the first guide shaft as the center, comes into contact with the opening edge portion 2201*a* or 2201*b* of the first bearing hole 2201 on the Z1 side and the Z2 side, it is not possible for the first guide shaft 9*a* to receive the load of the cap 15, and thus the state is not included in the state in which the recording head 3 tilts to come into contact with the first guide shaft 9*a*.

In the embodiment, as illustrated in FIG. 15, the tilting angle obtained when the recording head 3 tilts to come into contact with the first guide shaft 9*a* is set to an angle $\theta_1$ between the axial direction of the first guide shaft 9*a* and the penetrating direction (axial direction) of the first bearing hole 2201.

Similarly, as illustrated in FIG. 16, in a state in which the restrainer 14 does not restrain the recording head 3 from floating to the Z1 side, that is, a state in which the recording head 3 is provided to be liftable and lowerable in the third direction Z by the lifting/lowering mechanism 10, a state of the recording head 3 with respect to the second guide shaft 9*b* means a non-tilting state. In this respect, as illustrated in FIG. 17, when the cap 15 comes into contact with the recording head 3 and the load is applied thereto in a state of being restrained by the restrainer 14, the X1 side of the second guide shaft 9*b* in the first direction X comes into contact with an opening edge portion 2241*a* of the third bearing hole 2241 on the Z1 side, and the X2 side of the second guide shaft 9*b* comes into contact with an opening edge portion 2231*a* of the second bearing hole 2231 on the Z2 side. In this manner, the recording head 3 comes into contact with the second guide shaft 9*b* in the tilting state. The state in which the recording head 3 comes into contact with the second guide shaft 9*b* in the tilting state means that the second and third bearing holes and the second guide shaft come into contact with each other in a state in which the axial direction (penetrating direction) of the second bearing hole 2231 and the third bearing hole 2241 tilts with respect to the axial direction of the second guide shaft 9*b*. In addition, in the embodiment, the state in which the recording head 3 comes into contact with the second guide shaft 9*b* in the tilting state means a state in which one surface side of the second guide shaft 9*b* comes into contact with an opening edge portion 2241*a* of the third bearing hole 2241 on the Z1 side and the other surface side of the second guide shaft 9*b* comes into contact with an opening edge portion 2231*a* of the second bearing hole 2231 on the Z2 side in the first direction X as the tilting direction of the recording head 3. In addition, as will be described below in detail, the state in which the recording head 3 comes into contact with the second guide shaft 9*b* in the tilting state means a state in which one surface side of the second guide shaft 9*b* comes into contact with one portion of the opening edge portion 2241*a* or 2241*b* of the third bearing hole 2241 on the Z1 side and the Z2 side and the other surface side of the second guide shaft 9*b* comes into contact with the other portion of the opening edge portion 2241*a* or 2241*b* of the third bearing hole 2241 on the Z1 side and the Z2 side in the first direction X as the tilting direction. Similarly, the state in which the recording head 3 comes into contact with the second guide shaft 9*b* in the tilting state means a state in which one surface side of the second guide shaft 9*b* comes into contact with one portion of the opening edge portion 2231*a* or 2231*b* of the second bearing hole 2231 on the Z1 side and the Z2 side and the other surface side of the second guide shaft 9*b* comes into contact with the other portion of the opening edge portion 2231*a* or 2231*b* of the second bearing hole 2231 on the Z1 side and the Z2 side in the first direction X as the tilting direction.

In the embodiment, as illustrated in FIG. 17, the tilting angle obtained when the recording head 3 tilts to come into contact with the second guide shaft 9*b* is set to an angle $\theta_2$ between the axial direction of the second guide shaft 9*b* and the penetrating direction (axial direction) of the second bearing hole 2231 (the same as also for the third bearing hole 2241).

In the embodiment, as illustrated in FIG. 16, the second bearing hole 2231 of the second bearing 223 and the third bearing hole 2241 of the third bearing 224 have different inner diameters from each other. Specifically, the second bearing hole 2231 of the second bearing 223 has a larger diameter that of the third bearing hole 2241 of the third bearing 224. When viewed in plan view in the third direction Z, in the embodiment, the center of the second bearing hole 2231 and the third bearing hole 2241 is shifted, and the third bearing hole 2241 is disposed to be more shifted to the X1 side, on which the restrainer 14 is provided, than the second bearing hole 2231. In this manner, when the recording head 3 tilts in the first direction X and comes into contact with the second guide shaft 9*b*, the surfaces of the second guide shaft 9*b* on both sides in the first direction X can come into contact with the opening edge portion 2241*a* of the third bearing hole 2241 on the Z1 side and the opening edge portion 2231*a* of the second bearing hole 2231 on the Z2 side. In addition, the inner diameter of the third bearing hole 2241 is smaller than that of the second bearing hole 2231, and thereby a clearance between the third bearing hole 2241 and the second guide shaft 9*b* decreases such that it is possible to improve accuracy of positioning of the recording head 3 with respect to the second guide shaft 9*b*.

The tilting angle $\theta_1$ of the recording head 3 with respect to the first guide shaft 9*a* and the tilting angle $\theta_2$ of the recording head 3 with respect to the second guide shaft 9*b* are the same angle. In other words, the tilting angle $\theta_1$ of the recording head 3 obtained in the state in which the surfaces of the first guide shaft 9*a* on both sides in the first direction X come into contact with the opening edge portions 2201*a* and 2201*b* of the first bearing hole 2201 is the same angle as the tilting angle $\theta_2$ of the recording head 3 obtained in the state in which the surfaces of the second guide shaft 9*b* on both sides in the first direction X come into contact with the opening edge portion 2241*a* of the third bearing hole 2241 on the Z2 side and the opening edge portion 2231*a* of the second bearing hole 2231 on the Z1 side.

As described above, the tilting angle $\theta_1$ of the recording head 3 with respect to the first guide shaft 9*a* and the tilting angle $\theta_2$ of the recording head with respect to the second guide shaft 9*b* are the same angle. In this manner, the recording head 3 tilts to come into contact with both of the first guide shaft 9*a* and the second guide shaft 9*b*, and thereby it is possible to restrain the recording head 3 from being deformed in the torsional direction between the first guide shaft 9*a* and the second guide shaft 9*b*. Incidentally, in a case where the tilting angle $\theta_1$ at which the recording head 3 comes into contact with the first guide shaft 9*a* is different from the tilting angle $\theta_2$ at which the recording head comes into contact with the second guide shaft 9*b*, the recording head 3 comes into contact with the first guide shaft 9*a* and the second guide shaft 9*b*, and thereby the stress is applied in the torsional direction. The stress in the torsional direction is repeatedly applied to the recording head 3, and thereby the recording head 3 is deformed. Variations in ink droplet due to the deformation of the recording head 3 occur in a discharge direction from the head main bodies 100, and the print quality is degraded. In the embodiment, whenever the cap 15 comes into contact with the recording head 3, it is possible to restrain the stress from being applied in the torsional direction. Therefore, it is possible to restrain the recording head 3 from being deformed, and it is possible to restrain variations in ink droplet from occurring in the discharge direction from the head main bodies 100 such that it is possible to restrain the print quality from being degraded due to a shift in a landing position of the ink droplet.

Incidentally, as illustrated in FIG. 14, the tilting angle $\theta_1$ of the recording head 3 with respect to the first guide shaft 9*a* is represented as $\theta_1$=a tan($c_1/h_1$), based on an effective height $h_1$ of the first bearing hole 2201 of the first bearing 220 and a clearance $c_1$ between the first guide shaft 9*a* and the first bearing hole 2201. In this respect, as illustrated in FIG. 16, the tilting angle $\theta_2$ of the recording head 3 with respect to the second guide shaft 9*b* is represented as $\theta_2$=a tan($c_2/h_2$), based on an effective height $h_2$ of the second bearing hole 2231 of the second bearing 223 and the third bearing hole 2241 of the third bearing 224 and a clearance $c_2$ between the second guide shaft 9*b* and the second bearing hole 2231. Hence, the effective heights $h_1$ and $h_2$ and the clearances $c_1$ and $c_2$ of the first bearing 220, the second bearing 223, and the third bearing 224 may be appropriately set such that the tilting angle $\theta_1$ and the tilting angle $\theta_2$ have the same value.

As described above, in the embodiment, the guide shafts 9 are provided to guide the recording head 3 in the third direction Z in which the recording head 3 is lifted and lowered, the cap 15 is provided to be lifted and lowered in the third direction Z as the lifting/lowering direction of the recording head 3 and to cover the nozzle-formed surface 102 of the recording head 3, and the restrainer 14 is provided to restrain the recording head 3 against the cap 15 at the position shifted from the center of the cap 15 when viewed from the third direction Z. In this manner, when the cap 15 comes into contact with the nozzle-formed surface 102 of the recording head 3 restrained by the restrainer 14 and the load is applied thereto, the recording head 3 can tilt to come into contact with the guide shaft 9. Hence, the load of the cap 15 can be received by the restrainer 14 and the guide shaft 9 that tilts to be brought into contact with the recording head. Therefore, even when the material having relatively low stiffness is used as the restrainer 14, it is possible to restrain the restrainer 14 from being deformed and damaged such that it is possible to reduce the size and the costs of the restrainer 14. In addition, there is no need to reduce the load of the cap 15 with respect to the recording head 3 in order to restrain the restrainer 14 from being deformed, and it is possible to increase the load obtained when the cap 15 comes into contact with the nozzle-formed surface 102 such that it is possible to increase the sealing performance.

Therefore, it is possible to perform suctioning of the inside of the cap 15 such that it is possible to normally perform a suction operation of suctioning the ink from the nozzle openings 101 and it is possible to restrain the ink from evaporating from the nozzle openings 101.

In addition, in the embodiment, the guide shafts 9 are provided at a plurality of positions in the elongating direction in a case where the nozzle-formed surface 102 is viewed in the third direction Z as the lifting/lowering direction of the recording head 3. Specifically, the two first and second guide shafts 9*a* and 9*b* are provided at both end portions, respectively, in the second direction Y as the elongating direction of the recording head 3. As described above, the plurality of guide shafts 9 are provided in the second direction Y as the elongating direction of the recording head 3, and thereby the nozzle-formed surface 102 of the recording head 3 is unlikely to tilt in a direction in which the plurality of guide shafts 9 is aligned, that is, in the second direction Y. Hence, it is possible to reduce a shift of ink droplets, which are ejected from the recording head 3, in a flying direction such that it is possible to improve the print quality.

In addition, in the embodiment, the recording head 3 comes into contact with the guide shaft 9 in the tilting state, and the tilting angles $\theta_1$ and $\theta_2$ of the recording head 3 with respect to the plurality of guide shafts 9, that is, the first guide shaft 9*a* and the second guide shaft 9*b*, are the same angle. As described above, the tilting angle $\theta_1$ of the recording head 3 with respect to the first guide shaft 9*a* and the tilting angle $\theta_2$ of the recording head with respect to the second guide shaft 9*b* are the same angle, and thereby it is possible to restrain the stress in the torsional direction from being applied to the recording head 3. I is possible to restrain the recording head 3 from being deformed and damaged due to the repeated application of the stress in the torsional direction when the cap 15 repeatedly comes into contact therewith, to restrain the ink droplets from being shifted in the flying direction, and to restrain the variation in the landing position such that it is possible to improve the print quality.

In addition, in the embodiment, the recording head 3 is provided with the first bearing 220 and the second bearing 223 and the third bearing 224 which are bearings for the plurality of guide shafts 9, that is, the first guide shaft 9*a* and the second guide shaft 9*b*, respectively. The first bearing 220, the second bearing 223, and the third bearing 224 have intervals different for each guide shaft 9 in a direction along the line connecting the plurality of guide shafts 9, that is, the line L connecting the first guide shaft 9*a* and the second guide shaft 9*b*. In other words, the interval between the first bearing 220 and the first guide shaft 9*a* in the direction along the line L is set to a size different from that of the interval between the second guide shaft 9*b* and the second bearing 223 and the third bearing 224. In the embodiment, the first bearing hole 2201 of the first bearing 220 has the opening that is formed as a long hole elongating in a direction along the line L, and the second bearing hole 2231 of the second bearing 223 and the third bearing hole 2241 of the third bearing 224 are formed as the circular holes. The interval between the first bearing 220 and the first guide shaft 9*a* for each guide shaft 9 is set to a size different from that of the interval between the second guide shaft 9*b* and the second bearing 223 and the third bearing 224. In this manner, it is possible to perform the positioning on the side of the second bearing 223 and the third bearing 224 with the second guide shaft 9*b* as the reference and it is possible to absorb intersection variations on the side of the first guide shaft 9*a* of the side of the first bearing 220.

In addition, in the embodiment, the recording head 3 includes a plurality of bearings, that is, the second bearing 223 and the third bearing 224, with respect to the single second guide shaft 9*b*, and the second bearing hole 2231 of the second bearing 223 and the third bearing hole 2241 of the third bearing 224 have the center shifted when viewed in the third direction Z. In this manner, the recording head 3 can tilt to come into contact with the second guide shaft 9*b*, and it is possible to regulate the tilt to the smallest extent in a case of not tilting.

Embodiment 2

Figure 18:
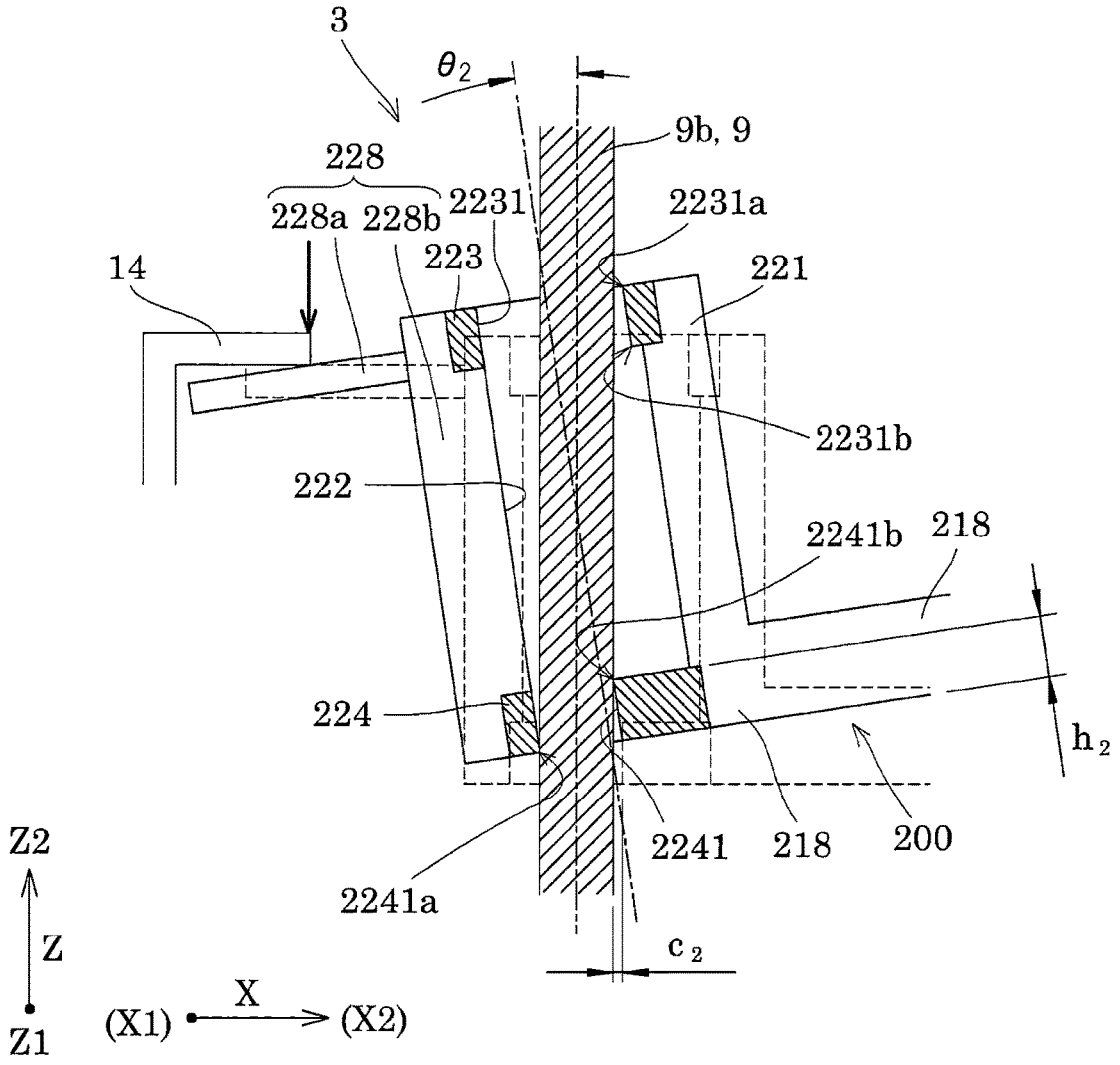
FIG. 18 is a cross-sectional view of main parts illustrating a tilting state of a recording head according to Embodiment 2.

FIG. 18 is a view illustrating an operation of the lifting/lowering mechanism and the ink jet type recording head as an example of a liquid ejecting head unit according to Embodiment 2 of the invention. The same reference signs are assigned to the same members as those in the embodiment described above, and detailed description thereof is omitted.

As illustrated in FIG. 18, when the cap 15 comes into contact with the nozzle-formed surface 102 of the recording head 3 and the load is applied thereto in a state in which the restrainer 14 restrains the recording head 3 from moving to the Z2 side, the recording head 3 tilts in the first direction X so as to come into contact with the second guide shaft 9*b*. At this time, the surfaces of the second guide shaft 9*b* on both sides in the first direction X as the tilting direction of the recording head 3 come into contact with the opening edge portion 2241*a* on the Z1 side and the opening edge portion 2241*b* on the Z2 side of the third bearing hole 2241. In other words, the second guide shaft 9*b* does not come into contact with the opening edge portions 2231*a* and 2231*b* of the second bearing hole 2231. In a case of such a configuration, the effective height $h_2$ that defines the tilting angle $\theta_2$ of the recording head 3 on the side of the second guide shaft 9*b* is set to the height of the third bearing hole 2241, and the clearance $c_2$ is set to a gap between the third bearing hole 2241 and the second guide shaft 9*b*, which is not particularly illustrated.

In addition, the inner diameter of the third bearing hole 2241 is smaller than the inner diameter of the second bearing hole 2231, and the center of the second bearing hole 2231 is disposed at a position shifted from the center of the third bearing hole 2241. In this manner, it is possible to have small clearance between the third bearing hole 2241 and the second guide shaft 9*b*. Thus, while the recording head 3 is restrained from tilting with respect to the second guide shaft 9*b* during the lifting and lowering of the recording head, the recording head 3 can tilt with respect to the second guide shaft 9*b* during the capping.

Other Embodiments

As described above, the embodiments of the invention are described; however the basic configuration of the invention is not limited to the configurations described above.

For example, in the embodiment described above, the curved plate-like member is provided as the restrainer 14; however, the configuration is not limited thereto as long as the recording head 3 is regulated from moving to the Z2 side. For example, the restrainer may a member that comes into contact with the surface of the unit base 200, on the Z2 side or a member that engages with a side surface or the like of the unit base 200. In addition, the restrainer 14 is not limited to a member that is provided in the lifting/lowering mechanism 10 and a drive device or the like, which causes the restrainer to move, may be separately provided from the lifting/lowering mechanism 10.

In addition, in the embodiments described above, the two first and second guide shafts 9*a* and 9*b* are provided as the guide shaft 9; however, the guide shaft is not limited thereto, and one guide shaft may be provided, or three or a plurality of guide shafts may be provided. Incidentally, in a case where one guide shaft is provided, for example, it is possible to regulate the movement of the recording head 3 in the rotating direction around the guide shaft as long as the guide shaft has a quadrangular cylindrical shape having a right-left asymmetrical cross section such as a rectangular cross section. In addition, the plurality of guide shafts more than two shafts may be provided to be adjacent to each other in the first direction X as the short direction of the recording head 3.

In addition, in the embodiments described above, two bearings, that is, the second bearing 223 and the third bearing 224, are provided for one second guide shaft 9*b*; however, the configuration is not particularly limited thereto, and three or more bearings may be provided for one second guide shaft 9*b*. In addition, only one bearing may be provided for the second guide shaft 9*b*. Similarly, two or more bearings may be provided for the first guide shaft 9*a*.

In addition, in the embodiments described above, the unit base 200 is provided with the wall portion 230; however, the configuration is not particularly limited thereto, and the unit base 200 may be configured of only the bottom portion 210.

In addition, in the embodiments described above, the wall portion 230 of the unit base 200 is provided on the surface side on which the head main bodies 100 are held, that is, on the Z1 side; however, the configuration is not particularly limited thereto, and the wall portion 230 may be provided on the Z2 side of the bottom portion 210. However, as the embodiments described above, when the wall portion 230 is provided on the Z1 side of the bottom portion 210, it is possible to decrease the recording head 3 in size, and it is possible to protect the side surface of the head main body 100 by the wall portion 230 such that it is possible to reduce damage caused when the head main bodies 100 come into contact with the recording sheet S. In addition, the side surfaces of the head main bodies 100 are protected by the wall portion 230, and thereby it is possible to restrain the ink from being attached to the stack interface of the head main body 100. The wall portion 230 may be provided on both sides of the Z1 side and the Z2 side of the bottom portion 210. In this manner, it is possible to increase stiffness of the recording head 3. However, the wall portion 230 is provided on the Z2 side of the bottom portion 210, and thereby the recording head 3 is likely to be increased in size in the third direction Z.

In addition, in the embodiment described above, the plurality of head main bodies 100 are screwed and fixed to the unit base 200 by using the spacers 300, the first screw member 401, and the second screw member 402; however, the configuration is not particularly limited thereto. For example, the plurality of head main bodies 100 may adhere to the unit base 200 with an adhesive or may be fixed by using a clip or the like.

In addition, in the embodiments described above, the alignment direction of the plurality of head main bodies 100 held in the unit base 200 is the second direction Y as the direction perpendicular to the first direction X as the transport direction of the recording sheet S; however, the configuration is not particularly limited thereto, and the head unit, in which the head main bodies 100 are aligned in the longitudinal direction of the unit base 200, may be disposed such that the plurality of head main bodies 100 have an alignment direction at an angle intersecting with the first direction X as the transport direction of the recording sheet S, that is, at an angle which is smaller than 90 degrees with respect to the first direction X. At this time, even when the nozzle array is provided in a direction perpendicular to the longitudinal direction of the unit base 200 in the in-plane direction of the nozzle-formed surface 102, the entire head unit tilts, and thereby it is possible to dispose the nozzle array inclined with respected to the first direction X as the transport direction.

In addition, in the embodiments described above, the head main bodies 100 are arranged in a straight line in the second direction Y; however, the configuration is not particularly limited thereto, and the head main bodies 100 may be arranged in a zigzag pattern in the second direction Y. Here, in the arrangement of the head main bodies 100 in the zigzag pattern in the second direction Y, the head main bodies 100 arranged in the second direction Y are disposed to be alternately shifted in the first direction X, and two rows of the head main bodies 100 arranged in the second direction Y are arranged side by side in the first direction X. However, when the head main bodies 100 as in Embodiments 1 and 2 described above are arranged in the straight line in the second direction Y, it is possible to decrease the recording head 3 in size in the first direction X, compared to the case of the arrangement in the zigzag pattern.

Further, in the embodiments described above, the fourth direction Xa as the alignment direction of the nozzle openings 101 of the head chip 110 is the direction inclined with respect to the second direction Y orthogonal to the first direction X as the transport direction; however, the fourth direction Xa as the alignment direction of the nozzle openings 101 may be the same direction as the first direction X as the transport direction, or the fourth direction Xa as the alignment direction of the nozzle openings 101 may be the same direction as the second direction Y. Further, the nozzle openings 101 are not limited to the openings provided in an array shape, and the nozzle openings 101 may be arranged in a matrix shape.

In addition, in the embodiments described above, the eccentric cam 12 or the like is used as the lifting/lowering mechanism 10; however, the lifting/lowering mechanism that causes the recording head 3 to be lifted and lowered in the third direction Z is not particularly limited thereto. For example, a contact member that comes into contact with the first contact surface 225 and the second contact surface 227 may be caused to reciprocate in the third direction Z by hydraulic pressure or drive of a motor. However, as the embodiments described above, it is possible to simplify the configuration by using the eccentric cam 12 as the lifting/lowering mechanism 10 such that it is possible to reduce the costs or decrease the size.

Further, in the embodiments described above, as the ink jet type recording apparatus 1, a so-called line type recording apparatus, in which the recording head 3 is fixed to the apparatus main body 2, only the recording sheet S is transported, and thereby printing is performed, is exemplified; however, the apparatus is not particularly limited thereto, and the invention can be applied to a so-called serial type recording apparatus in which the recording head 3 is mounted on a carriage that moves in a direction intersecting with the first direction X as the transport direction of the recording sheet S, for example, in the second direction Y, and printing is performed while the recording head 3 moves in the direction intersecting with the transport direction. In addition, the configuration is not limited to the configuration in which the recording sheet S is transported with respect to the recording head 3, and printing may be performed by a configuration in which the recording head 3 is caused to move with respect to the recording sheet S, or the recording sheet S may be relatively transported with respect to the recording head 3.

In the embodiments described above, an ink jet type recording apparatus is described as an example of a liquid ejecting apparatus; however, the invention is widely applied to a liquid ejecting apparatus in general, as a target, and can be also applied to a liquid ejecting apparatus including a liquid ejecting head that ejects liquids other than ink. Examples of other liquid ejecting heads include various recording heads that are used in an image recording apparatus such as a printer, a color material ejecting head that is used in manufacturing a color filter of a liquid crystal display or the like, an electrode material ejecting head that is used in forming electrodes of an organic EL display, a field emission display (FED), or the like, a bioorganic material ejecting head that is used in manufacturing a biochip, and the invention can be applied to a liquid ejecting apparatus including the liquid ejecting head.

What is claimed is:

1. A liquid ejecting apparatus comprising:

a liquid ejecting head that has a nozzle-formed surface;

guide shafts that guide the liquid ejecting head in a direction in which the liquid ejecting head is to be lifted and lowered;

a cap that is to be lifted and lowered in the direction and configured to cover the nozzle-formed surface; and a restrainer that is configured to restrain the liquid ejecting head against the cap at a position shifted from the center of the cap when viewed from the direction.

2. The liquid ejecting apparatus according to claim 1, wherein the guide shafts are provided at a plurality of positions in an elongating direction in a case where the nozzle-formed surface is viewed in the direction.

3. The liquid ejecting apparatus according to claim 2, wherein the liquid ejecting head is configured to come into contact with the guide shafts in a tilting state, and the liquid ejecting head has the same tilting angle between the plurality of guide shafts.

4. The liquid ejecting apparatus according to claim 3, wherein the liquid ejecting head is provided with a bearing for each guide shaft, and wherein the bearings are provided at an interval different for each guide shaft in a direction along a line connecting the plurality of guide shafts.

5. The liquid ejecting apparatus according to claim 4, wherein the liquid ejecting head is provided with a plurality of bearings having different diameters for the one guide shaft, and wherein the centers of the bearings shift from each other when viewed in the direction.

6. The liquid ejecting apparatus according to claim 5, further comprising:

a plurality of eccentric cams that are configured to lift and lower the liquid ejecting head.

7. The liquid ejecting apparatus according to claim 6, wherein the liquid ejecting head has a unit base with which the plurality of eccentric cams are configured to come into contact.

8. The liquid ejecting apparatus according to claim 2, wherein the liquid ejecting head is provided with a bearing for each guide shaft, and wherein the bearings are provided at an interval different for each guide shaft in a direction along a line connecting the plurality of guide shafts.

9. The liquid ejecting apparatus according to claim 1, wherein the liquid ejecting head is provided with a plurality of bearings having different diameters for the one guide shaft, and wherein the centers of the bearings shift from each other when viewed in the direction.

10. The liquid ejecting apparatus according to claim 2, wherein the liquid ejecting head is provided with a plurality of bearings having different diameters for the one guide shaft, and wherein the centers of the bearings shift from each other when viewed in the direction.

11. The liquid ejecting apparatus according to claim 3, wherein the liquid ejecting head is provided with a plurality of bearings having different diameters for the one guide shaft, and wherein the centers of the bearings shift from each other when viewed in the direction.

12. The liquid ejecting apparatus according to claim 1, further comprising:

a plurality of eccentric cams that are configured to lift and lower the liquid ejecting head, wherein the liquid ejecting head has a unit base with which the plurality of eccentric cams are configured to come into contact.

13. A capping method comprising:

preparing a liquid ejecting head that has a nozzle-formed surface, guide shafts that guide the liquid ejecting head in a direction in which the liquid ejecting head is lifted and lowered, a cap that is lifted and lowered in the direction and covers the nozzle-formed surface, and a restrainer that restrains the liquid ejecting head against the cap at a position shifted from the center of the cap when viewed in the direction; and causing the liquid ejecting head to tilt so as to come into contact with the guide shaft by causing the cap to come into contact with the liquid ejecting head in a state in which the restrainer restrains the liquid ejecting head.

14. The capping method according to claim 13, wherein the guide shafts are provided at a plurality of positions in an elongating direction in a case where the nozzle-formed surface is viewed in the direction.

15. The capping method according to claim 14, wherein the liquid ejecting head comes into contact with the guide shafts in a tilting state, and the liquid ejecting head has the same tilting angle between the plurality of guide shafts.

16. The capping method according to claim 15, wherein the liquid ejecting head is provided with a bearing for each guide shaft, and wherein the bearings are provided at an interval different for each guide shaft in a direction along a line connecting the plurality of guide shafts.

17. The capping method according to claim 16, wherein the liquid ejecting head is provided with a plurality of bearings having different diameters for the one guide shaft, and wherein the centers of the bearings shift from each other when viewed in the direction.

* * * * *